US011473363B2

(12) United States Patent
Salentine et al.

(10) Patent No.: US 11,473,363 B2
(45) Date of Patent: Oct. 18, 2022

(54) PROJECTING FENESTRATION ASSEMBLY AND METHODS FOR SAME

(71) Applicant: Marvin Lumber and Cedar Company, LLC

(72) Inventors: Eric Lee Salentine, Warroad, MN (US); Justin Wayne Magnusen, Roosevelt, MN (US); Michael T. Nelsen, Madison, AL (US)

(73) Assignee: Marvin Lumber and Cedar Company, LLC, Eagan, MN (US)

( * ) Notice: Subject to any disclaimer, the term of this patent is extended or adjusted under 35 U.S.C. 154(b) by 68 days.

(21) Appl. No.: 16/892,503

(22) Filed: Jun. 4, 2020

(65) Prior Publication Data

US 2020/0386038 A1 Dec. 10, 2020

Related U.S. Application Data

(60) Provisional application No. 62/857,181, filed on Jun. 4, 2019.

(51) Int. Cl.
*E06B 1/36* (2006.01)
*E06B 7/10* (2006.01)

(52) U.S. Cl.
CPC ..... *E06B 1/363* (2013.01); *E06B 1/366* (2013.01); *E06B 7/10* (2013.01)

(58) Field of Classification Search
CPC ... E06B 1/04; E06B 1/36; E06B 1/363; E06B 1/366; E06B 1/02; E06B 1/60; E06B 7/10; E06B 7/28; E04B 1/003
See application file for complete search history.

(56) References Cited

U.S. PATENT DOCUMENTS 1,152,899 A * 9/1915 Moore ..... E06B 7/28 47/40
1,214,057 A * 1/1917 Moore ..... E06B 7/28 47/40
1,380,237 A * 5/1921 Neff ..... E06B 7/28 160/183
1,543,739 A * 6/1925 Vowels ..... E06B 7/28 454/222
2,074,872 A * 3/1937 Thorin ..... A47B 71/00 47/40

(Continued)

OTHER PUBLICATIONS

"Invisio Oriel Windows", IQ Glass UK, [Online] Retrieved from the Internet: <URL: https://www.iqglassuk.com/products/invisio-oriel-windows/s14946/>, (Retrieved on Jun. 4, 2020), 14 pgs.

*Primary Examiner* — Kyle J. Walraed-Sullivan
(74) *Attorney, Agent, or Firm* — Schwegman Lundberg & Woessner, P.A.

(57) ABSTRACT

A projecting fenestration assembly includes a window shell having a plurality of component translucent panels. The window shell includes a shell frame having shell edges and a shell base. The plurality of component translucent panels are seated within the shell frame and surround a light cavity. A carriage frame is coupled with the window shell and supports the window shell. The carriage frame includes one or more carriage struts and a carriage tray extending from the one or more carriage struts to a tray end. The one or more carriage struts are coupled along the shell edges of the window shell. The carriage tray is coupled along the shell base.

35 Claims, 17 Drawing Sheets

(56) References Cited

U.S. PATENT DOCUMENTS

| | | | | | |
|---|---|---|---|---|---|
| 2,834,441 | A * | 5/1958 | Burns | E06B 1/363 | 52/73 |
| 3,127,697 | A * | 4/1964 | Romenko | E06B 7/04 | 47/40 |
| 4,009,546 | A * | 3/1977 | Buck, Jr. | E06B 1/363 | 52/27 |
| 4,103,466 | A * | 8/1978 | Nagase | E06B 1/363 | 52/73 |
| 4,335,547 | A * | 6/1982 | Maxwell | E04B 1/003 | 52/DIG. 17 |
| 4,571,899 | A * | 2/1986 | Minter | E04D 3/14 | 52/395 |
| 5,099,623 | A * | 3/1992 | Smith | E06B 1/363 | 52/201 |
| 5,400,557 | A * | 3/1995 | Glover | E05F 11/16 | 49/339 |
| 5,458,287 | A * | 10/1995 | Jones | E06B 1/363 | 232/43.1 |
| 6,729,082 | B1 * | 5/2004 | Oldham | E06B 1/363 | 52/201 |
| 2019/0242137 | A1 * | 8/2019 | Noohi | E04B 1/003 | |
| 2020/0056424 | A1 * | 2/2020 | Farnes | E04D 13/0325 | |

* cited by examiner

PROJECTING FENESTRATION ASSEMBLY AND METHODS FOR SAME

PRIORITY APPLICATION

This application claims priority to U.S. Provisional Application Ser. No. 62/857,181, filed Jun. 4, 2019, the disclosure of which is incorporated herein in its entirety by reference.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Marvin Cedar and Lumber Co., LLC. All Rights Reserved.

TECHNICAL FIELD

This document pertains generally, but not by way of limitation, to fenestration assemblies including windows and doors.

BACKGROUND

Fenestration assemblies, including window or door assemblies, are installed in buildings to provide access for instance, with doors and openable windows, as well as to facilitate a view and delivery daylight to the interior of buildings, for example with windows and some doors.

In some examples, a portion of the building frame structure is built out to provide a bay, protruding frame structure or the like. For instance, wood or metal studs are assembled and coupled with the building. Windows are installed in the protruding frame structure (e.g., checked for plumb and level, fastened in place and the like). In some examples, the protruding frame structure and the window assemblies thereon are reinforced with underlying box frames, angled frames, cables, cords or the like to support the protruding frame structure and the window assemblies.

Overview

The present inventors have recognized, among other things, that a problem to be solved can include streamlining the assembly and installation of protruding fenestration assemblies. Protruding fenestration assemblies are specified to provide enhanced daylight, exterior views or the like in comparison to fenestration assemblies such as double hung windows, casement windows or the like. Bay windows are one example of a protruding fenestration assembly.

Previous protruding fenestration assemblies include custom built or on site constructed framing, support or the like. For instance, framers and structural engineers design and construct box or angled frames including metal or wood studs extending from the building to support windows for the protruding fenestration assembly. The constructed frames are engineered to support windows installed therein. Windows are installed to the constructed frames. In various examples, each of the windows is adjusted for plumb and level, fastened to the constructed frame and sealed (e.g., with gaskets, weather stripping or the like). Additional installation steps are performed in some examples including coupling of cables, cords or rods (e.g., hangers) with components of the protruding fenestration assembly to offset some of the load. Roofing, capping, flashing or the like are installed to finish the installation in other examples. Construction and installation of the protruding fenestration assemblies is accordingly a time consuming and labor-intensive endeavor.

In other examples, if seating is desired in the protruding fenestration assembly, additional framing and support are constructed to support the potential additional load from the occupant(s). One or more additional services are specified in other installations including, but not limited to, ventilation, window treatments or the like. These services prompt work from additional tradesmen including, but not limited to, HVAC technicians, electricians or the like. Additionally, each of supplemental framing or inclusion of services to the protruding fenestration assembly further aggravates the construction and installation of the fenestration assembly.

The present subject matter provides solutions to these problems with a projecting fenestration assembly. Examples of projecting fenestration assemblies are described herein and include a window shell coupled with a carriage frame. The window shell includes a plurality of component translucent panels (component windows in some examples) surrounding a light cavity. A carriage frame is coupled with the window shell, and includes a carriage tray and one or more carriage struts extending from the carriage tray. The projecting fenestration assembly including the window shell and carriage frame are received at a work site in an assembled configuration and ready for installation. Time consuming and labor-intensive building of a projecting frame, installation of support cables, cords, rods or the like are minimized (e.g., decreased or eliminated).

The assembly is positioned at a rough opening, and the one or more carriage struts are coupled with a rough opening frame. The one or more carriage struts and the carriage tray of the carriage frame support the window shell (and optionally a seat and occupants) without an over or underlying box frame, cords, cables or the like. Instead, the load of the window shell including both weight and moment are distributed through the carriage frame (e.g., to the carriage tray, and from the carriage tray to the carriage struts coupled with the rough opening frame). In one example, the carriage struts are coupled in a distributed configuration along upright members of the rough opening frame, for instance with anchor brackets installed between the upright members and the carriage struts. With coupling of the projecting fenestration assembly to the rough opening frame with the carriage frame the installation of the assembly is structurally complete, and supplemental installation steps are conducted including flashing, coupling of ornamental fascia, connection of one or more service ducts with building utilities (For instance, HVAC ducts or electrical wiring) or the like.

Additionally, the example projecting fenestration assemblies described herein include window shell and carriage frame profiles configured to correspond (e.g., match, conform, fit within each other or the like) and accordingly minimize the profile of the assemblies. For instance, a carriage profile of the carriage frame of the assembly corresponds with a shell profile of the window shell. In one example, the assembly provides the appearance that the window shell 'floats' relative to the building without under or overlying box or angled frames used in other assemblies. Instead, the carriage frame has a corresponding carriage profile to the shell profile, and is thereby concealed by the shell profile.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
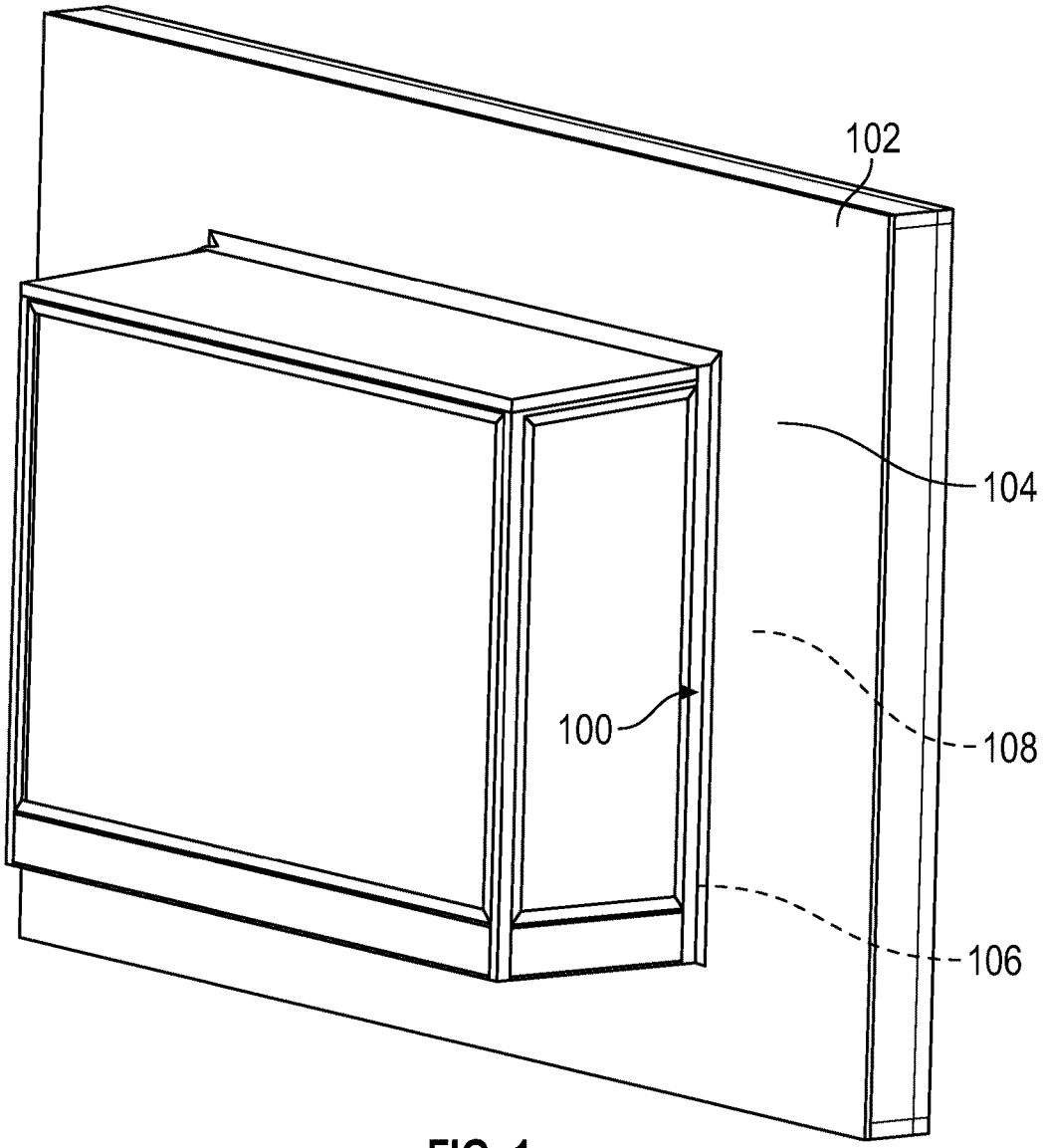
FIG. 1 is a perspective view of one example of a projecting fenestration assembly coupled with a building.

FIG. 1 is a perspective view including one example of a projecting fenestration assembly 100 in an installed configuration within a rough opening 106, for instance coupled with a rough opening frame 108 (designated with a broken lead line and shown herein) in a wall 104 of a building 102.

The projecting fenestration assembly 100 includes a window shell having one or more component translucent panels. The window shell is coupled with a carriage frame, and the carriage frame is coupled with the rough opening frame. As described herein, the carriage frame has a corresponding profile to the window shell and the projecting fenestration assembly 100 has a compact overall profile in comparison to other fenestration assemblies including built out framing, hangers or the like. The carriage frame is configured to support itself, the window shell, components such as shades, lighting, a seat, seat occupants or the like while maintaining a corresponding profile to the window shell. For instance, the carriage frame includes a carriage tray 210 and one or more carriage struts 212 that distribute loads, such as forces and moments, into the surrounding rough opening frame 108.

Figure 2:
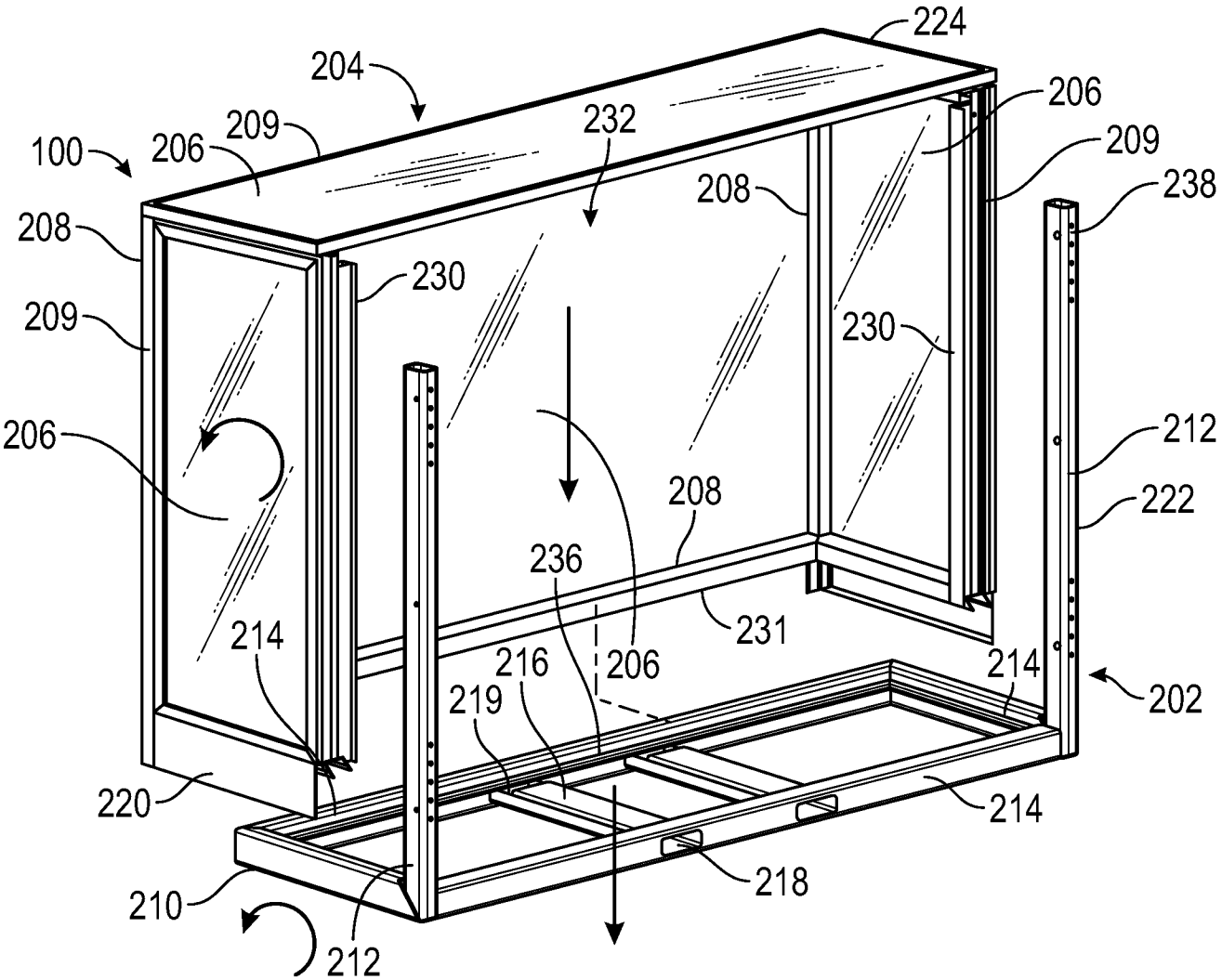
FIG. 2 is an exploded view of the projecting fenestration assembly of FIG. 1.

Referring now to FIG. 2, an exploded view of the projecting fenestration assembly 100 is shown. The carriage frame 202 is decoupled from the window shell 204. The carriage frame 202 includes, in this example, two carriage struts 212 extending from a carriage tray 210 to respective strut ends 238. In one example, the carriage struts 212 are coupled with the rough opening frame 108 with one or more anchor brackets, bolts or the like to anchor the assembly 100 and support each of the carriage frame 202, window shell 204, seat, seat occupant or the like. The carriage tray 210 is cantilevered from the remainder of the carriage tray 210 including the carriage struts 212.

As further shown in FIG. 2, the carriage tray 210 extends from the carriage struts 212 toward a tray end 236. For example, one or more tray members 214 extend from the struts 212 toward the tray end 236. The carriage tray 210 includes, in this example, tray members 214 extending along each of the sides of the carriage tray 210. The window shell 204 is coupled with the carriage frame 202 as described herein. For instance, the window shell 204 includes one or more sockets (e.g., fittings, recesses, pins or the like) that interfit with components of the carriage frame 202 to securely couple the window shell 204 with the carriage frame 202.

In an installed configuration (as shown herein) the projecting fenestration assembly 100 experiences a variety of loads including forces and moments based on the mass of the assembly itself, occupants seated within the assembly, and potential household items or decorations within the assembly (plants, decorations or the like). For instance, the weight of the window shell 204 and the carriage frame 202 is transmitted and support with the carriage frame 202. The carriage frame 202 absorbs and distributes these forces, for instance through the carriage struts 212 (and to the rough opening frame coupled with the struts). Additionally, because the fenestration assembly 100 is cantilevered (e.g., without an under or overlying support frame, hangers or the like) each of the window shell 204, carriage frame 202, and occupants generate corresponding moments that are experienced by the assembly 100. Relative to FIG. 2, these moments are generally counterclockwise as shown. The carriage frame 202, having the carriage struts 212, is coupled with the rough opening frame and the struts 212 transmit the loads (e.g., forces and moments) to the rough opening frame to robustly maintain and support the assembly 100 in the installed configuration.

In another example, the carriage frame 202 includes one or more access ports 218 and service ducts 216. In an installed configuration the access ports 218 and the service ducts 216 optionally provide utility functionality into or through the projecting fenestration assembly 100. For example, wiring, ventilation or the like are delivered to the assembly 100 through the ports 218 and ducts 216 to corresponding light modulating elements (e.g., shades, lights or the like), vents or the like. In other examples, the access ports 218 and service ducts 216 are located within the projecting fenestration assembly 100 for assistance during installation. For instance, the ports 218 and the associated ducts 216 are located along the assembly 100 to receive a fork of a forklift, lift or the like. The projecting fenestration assembly 100 is readily lifted for installation to a rough opening 106 with the ports 218 and the ducts 216 and held in place while technicians couple the assembly within the rough opening 106.

The window shell 204 is shown with the component translucent panels 206 assembled in FIG. 2. In the example shown the assembly includes translucent panels 206 in each of the front and two side portions of the shell surrounding a light cavity 232. The light cavity 232 includes the interior portion of the projecting fenestration assembly 100 projecting from the rough opening, and is readily illuminated by ambient light (daylight) delivered through the translucent panels 206 from the exterior. Optionally, a component translucent panel 206 is provided as a canopy translucent panel (e.g., along an upper portion or the window shell 204). The translucent panels 206 include, but are not limited to, transparent panels, translucent panels, tinted panels, operably tinted panels (e.g., operable or adjustable tinting), operably opacifying panels (e.g., operable or adjustable opacity) or the like.

The window shell 204 includes a shell frame 208 provided between the component translucent panels that maintains the panels 206 in a specified orientation and robustly supports the panels 206, for instance in inclement weather. Optionally, the shell frame 208 includes a plurality of component frames associated with component windows 209. For instance, the window shell 204 is, in one example, a plurality of component windows 209 coupled together as the shell. Each of the component windows 209 includes one of the component translucent panels 206 and a portion of the shell frame 208 proximate to the component translucent panel 206 of the component window 209. As described herein the component windows 209 are coupled together along the respective portions of the shell frame 208 with one or more mullion members to assemble the window shell 204.

Referring again to FIG. 2, the window shell 204 includes shell edges 230 and a shell base 231. In an assembled configuration the shell edges 230 are coupled along the carriage struts 212, and the shell base 231 is coupled along the carriage tray 210. For instance, sockets provided along the shell edges 230 receive corresponding portions of the carriage struts 212. Optionally, a fastener, such as screws, bolts, pins or the like, maintains coupling between the window shell 204 and the carriage struts 212. In other examples the window shell 204 includes fascia 220 that provide an aesthetic cover or veneer to the projecting fenestration assembly 100, for instance to provide a corresponding exterior surface including a painted or finished surface (or optionally provides a contrasting or complementary surface to enhance aesthetics)

As further shown in FIG. 2 the window shell 204 includes a shell profile 224 corresponding to the footprint of the window shell 204. As shown in the example the shell profile 224 has a generally rectangular cube profile. The carriage frame 202 includes a corresponding carriage profile 222 to the shell profile 224. For instance, the footprint of the carriage tray 210 and the carriage struts 212 corresponds with the profile of the window shell 204. Accordingly, upon assembling the window shell 204 with the carriage frame 202 the carriage profile 222 corresponds with the shell profile 224 and the overall profile of the projecting fenestration assembly 100 is minimized. For instance, neither of the shell profile 224 or the carriage profile 222 is more than incidentally larger than the other profile and the profile of the window assembly 100 is not otherwise enlarged based on additional framing, hanging elements or the like.

Figure 3:
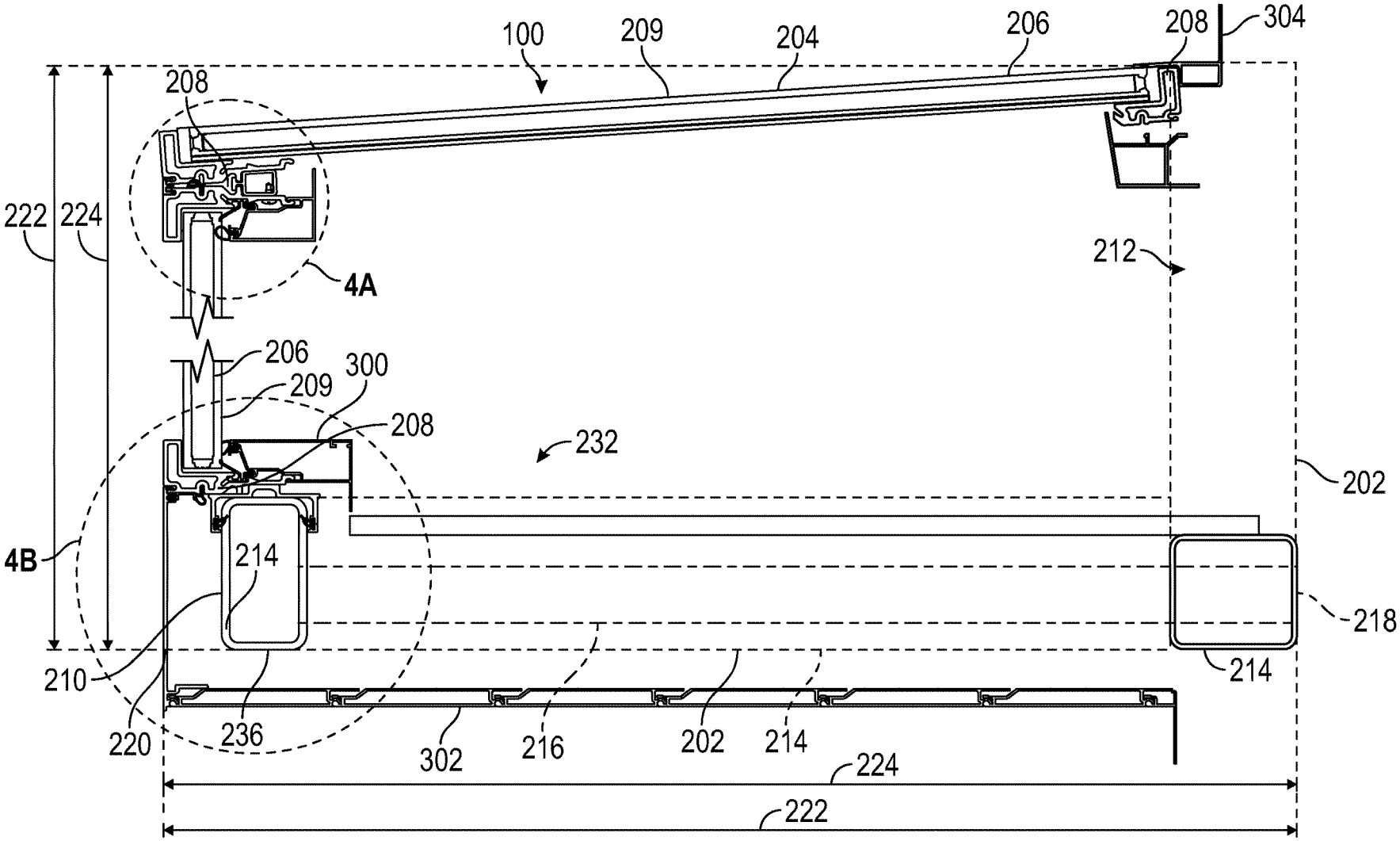
FIG. 3 is a cross sectional view of the projecting fenestration assembly of FIG. 1.

FIG. 3 is a cross sectional view of the projecting fenestration assembly 100 including the window shell 204 coupled with the carriage frame 202. Examples of the shell profile 224 and the carriage profile 222, previously discussed in FIG. 2, are shown in FIG. 3. As shown in FIG. 3, the carriage profile 222 and shell profile 224 are similar and correspond. For instance, the carriage profile 222 includes incidental projections, features or the like outside of the shell profile 224 and accordingly fits within the shell profile 224. In one example, the carriage profile 222 is concealed within the shell profile 224, and the projecting fenestration assembly 100 has a floating appearance when installed along a wall because the supporting structure, the carriage frame 202, corresponds with the window shell 204. Accordingly, the projecting fenestration assembly 100 has an overall minimized profile that does not include framing, hangers or the like that otherwise expand an overall profile of other fenestration assemblies.

Referring again to FIG. 3, the carriage frame 202 includes a plurality of tray members 214 in the carriage tray 210. As shown, a first tray member 214 extends from proximate the carriage strut 212 toward the tray end 236. In this example, the extending tray member 214 extends from a tray member 214 that itself extending into and out of the page between the carriage struts 212. The extending tray member 214 extends to another tray member 214 proximate to the tray end 236. The tray members 214 and the carriage struts 212 are constructed with robust materials, including metals, such as steel, powder coated steel or the like configured to support the forces and moments of the fenestration assembly 100, couple the assembly 100 with the rough opening frame, and distribute forces and movements to the rough opening frame.

As further shown in FIG. 3 in broken lines an example service duct 216 extends from the tray member 214 proximate the carriage strut 212 to the tray end 236. In one example, the service duct 216 extends through the tray members 214 to facilitate access to the service duct, for instance with a forklift, lift mechanism or the like for installation. Optionally, the service duct 216 is provided as a pair of ducts and are open along the exterior facing portion of the assembly 100 to provide access by a forklift or other lift mechanism. In another example, the service duct 216 is configured to provide one or more utilities or service access through the assembly 100, for instance through the access port 218 shown in FIG. 3. The service duct 216 thereby provides ready access to the fenestration assembly 100 for HVAC ducts, electrical wiring or the like. As described herein, the service ducts 216 provide one or more of ventilation to the assembly for distribution through one or more vents, power for light modulating elements (e.g., light arrays or the like).

The window shell 204 is coupled with the carriage frame 202 as shown. For instance, the window shell 204 includes a shell frame 208 coupled with the carriage frame 202. As shown in FIG. 3, the shell frame 208 optionally includes a plurality of component frame members coupled with associated component translucent panels 206 (e.g., in the manner of component windows 209). The shell frame 208 and the translucent panels 206 form the window shell 204, and the window shell is coupled along the carriage frame 202, for instance with the carriage struts 212 and tray members 214. As described herein, the window shell 204 is in one example coupled with the carriage frame 202 with one or more sockets (e.g., fittings, recesses, pins or the like) that interface with corresponding components of the carriage frame 202. Optionally, the sockets and components are complementary, for instance the shell frame 208 includes one or more sockets that receive components of the carriage frame 202, such as portions of the tray members 214, carriage struts 212 or the like.

Referring again to FIG. 3, the projecting fenestration assembly 100 optionally includes one or more components that provide a specified appearance or 'look' to the assembly 100. For example, fascia 220 are coupled over portions of the assembly 100, such as the carriage tray 210 including one or more tray members 214. The fascia 220 conceal or obscure the tray members 214, service ducts 216 or the like and provide a consistent decorative appearance for the projecting fenestration assembly 100. In another example, fascia include soffits 302 provided along an underside of the fenestration assembly 100. Optionally, the soffits 302 are coupled with the fascia 220 and extend from the fascia 220 toward the portion of the carriage tray 210 proximate to the carriage struts 212.

As further shown in FIG. 3, interior fascia 300 are optionally provided along one or more of the window shell 204 or the carriage frame 202 to conceal components of the fenestration assembly, such as the carriage frame 202 shell frame 208 or the like. The interior fascia 300, like the fascia 220, optionally include paint, finish, contour or the like to provide an aesthetic appeal. As shown in FIG. 3, the interior fascia 300 and fascia 220 are optionally coupled with the fenestration assembly 100 with cooperating fittings interfit with portions of the shell frame 208. For instance, one or more of the fascia 220, 300 or shell frame 208 include projections, recesses, barbs or the like configured to interfit and reliably maintain the fascia installed with the assembly 100.

As previously described, the carriage frame 202 couples the fenestration assembly 100 with the rough opening frame. For example, the carriage struts 202 are fastened with components of the rough opening frame to distribute loads from the projecting fenestration assembly 100 to the rough opening frame. In another example, features such as installation flanges 304 are included with the fenestration assembly to further couple the assembly 100 with the rough opening frame. The installation flanges 304 are similar to nailing flanges in some examples, and provide an interface from the building to the projecting fenestration assembly 100. The installation flanges 304 optionally divert moisture including rain, condensation or the like otherwise incident at the interface of the fenestration assembly 100 and the rough opening frame. For instance, the installation flange 304 provided along the shell frame 208 in FIG. 3 diverts moisture to the sloped component translucent panel 206 and the moisture eventually flows off of the assembly 100 to the ground.

Figure 4A:
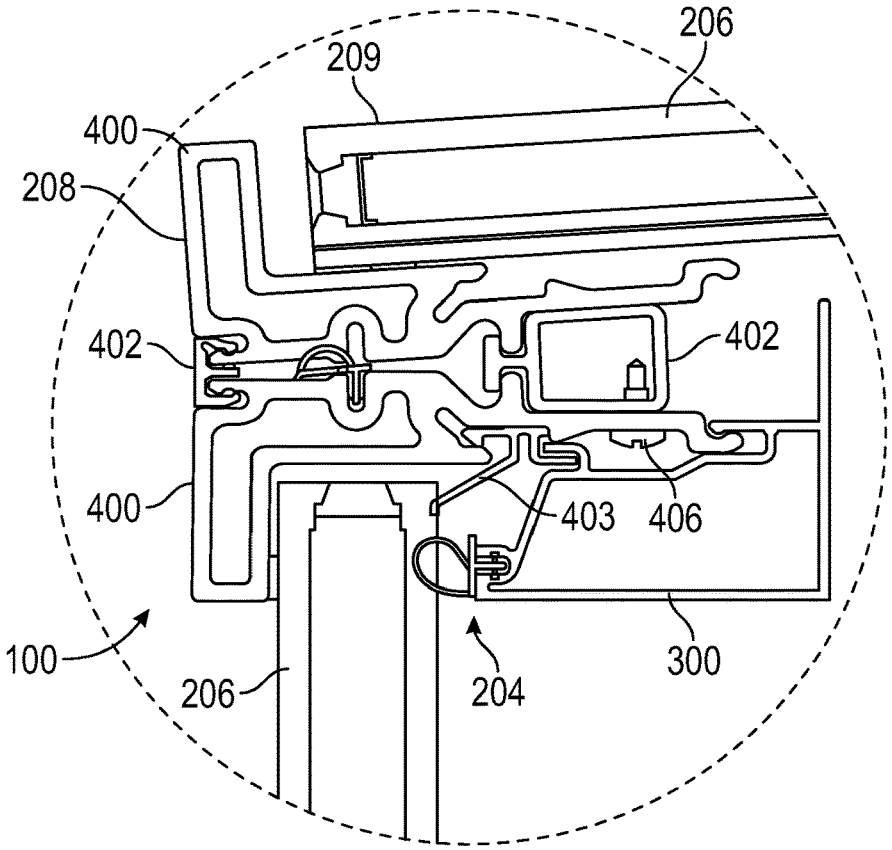
FIG. 4A is a detailed cross sectional view of a portion of the projecting fenestration assembly shown in FIG. 3.

FIG. 4A is a detailed cross sectional view of the example projecting fenestration assembly 100 shown in FIG. 3. The portion of the assembly 100 shown includes a first component translucent panel 206 transitioning into a second (canopy) component translucent panel 206. The second component translucent panel 206 optionally includes a slope for moisture diversion (e.g., of 3 or more degrees, 10 degrees or the like).

In the example shown in FIG. 4A, each of the panels 206 are associated with component windows 209 each having a panel 206 and a component frame 400. The component frames 400 are coupled with the associated panels 206 with one or more of adhesives, fasteners, welds, fittings or the like. As shown in FIG. 4A, a glazing clamp 403 is coupled with one of the component frames 400 and includes a flange engaged with the component translucent panel 206 that retains the panel 206 within frame 400. The flange of the glazing clamp 403 is deflectable and configured to bias the component translucent panel 206 toward the seated position shown.

As further shown in FIG. 4A, one or more mullion members 402 couple the component frames 400 together. The mullion members 402 include cooperative fittings that fasten the frames 400 together and provide a bridge between the frames. As shown in FIG. 4A, mullion members 402 are optionally provided along the exterior and interior of the fenestration assembly 100, for instance as clips, clamps, blocks or the like that provide interfaces between the frame 400. Optionally, one or more supplemental fasteners 406, such as screws or the like, couple the mullion members 402 with the component frames 400.

The window shell 204 shown in FIG. 4A includes another example of the interior fascia 300 coupled with the remainder of the window shell 204. In this example, the interior fascia 300 is a fitted panel that couples with corresponding portions of the component frame 400 of the first (vertical) component translucent panel 206. As shown, the interior fascia 300 conceals components of the window shell 204, such as the component frames 400, and provides a contoured aesthetic veneer for the fenestration assembly 100 at the interface between component translucent panels 206.

Figure 4B:
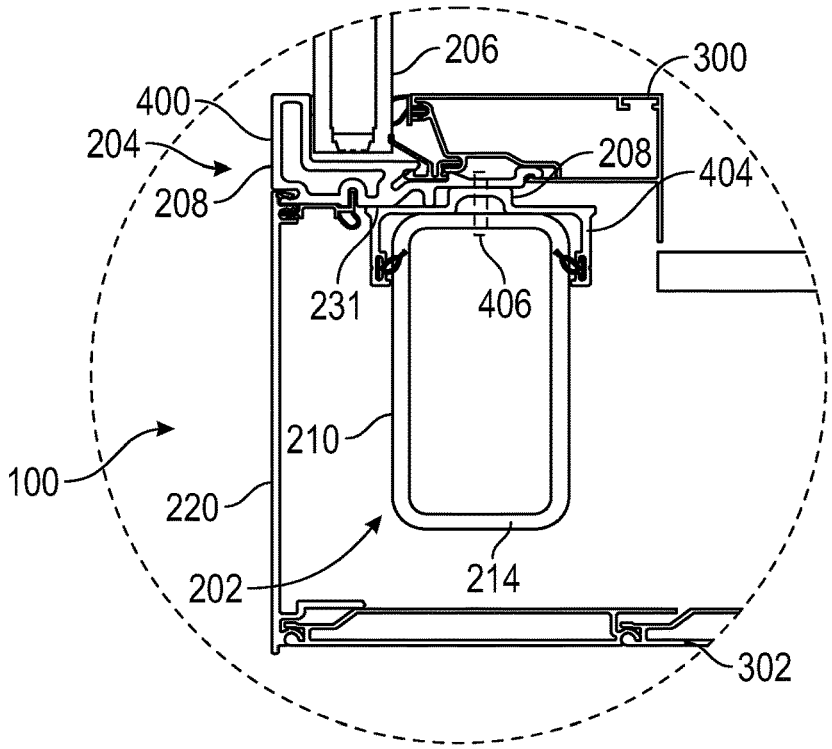
FIG. 4B is another detailed cross sectional view of a portion of the projecting fenestration assembly shown in FIG. 3.

FIG. 4B is another detailed sectional view of the projecting fenestration assembly 100 showing a lower portion of the assembly. The carriage tray 210 of the carriage frame 202 includes a tray member 214 extending into and out of the page. As shown, the carriage frame 202 is coupled with the window shell 204, for instance with the shell frame 208 of the shell 204. As previously described the window shell 204 optionally includes component frames 400 associated with the component translucent panels 206 that form component windows 209 (see FIGS. 2 and 3).

In the example shown in FIG. 4B, a component frame 400 of the shell frame 208 includes a socket 404 that interfits with the tray member 214 of the carriage frame 202. The socket 404 includes, but is not limited to, a recessed pocket, groove, pin, fitting, post or the like configured to interfit with a portion of the carriage frame 202 and maintain the window shell 204 coupled and aligned with the carriage frame 202. As shown in this example, the socket 404 includes an interior recessed profile similar to a portion of the tray member 214 profile. For example, the socket 404 includes a recess, and optionally one or more of a gasket, seal, adhesive, weld or the like to further enhance coupling of the tray member 214 with the socket and optionally minimize the ingress of moisture, drafts or the like. In another example a fastener 406, such as a screw, pin, stud, or the like is provided between carriage frame 202 with the window shell 204 to further enhance coupling.

Additionally, the socket 404 receives a portion of the shell frame 208 (e.g., along the shell base 231) and aligns the window shell 204 with the carriage frame 202. The alignment is maintained through one or more of the sockets 404 provided with corresponding portions of the window shell 204 (or tray members if provided with sockets) and the interfitting of the sockets 404 with the carriage frame 202. Accordingly, the window shell 204 is readily maintained in a coupled and aligned configuration with the carriage frame 202 (e.g., during assembly, transport, installation and the lifetime of the fenestration assembly).

As further shown in FIG. 4B, fascia 220 is provided along an exterior portion of the fenestration assembly 100. In this example, the fascia 220 is coupled with the window shell, for instance the shell frame 208, with fittings (e.g., clips, projections, recesses or the like) having complementary profiles. The fascia 220 extends from the shell frame 208, and optionally has a corresponding appearance to match the exposed portion of the shell frame 208. As shown in FIG. 4B, the fascia 220 is coupled with soffits 302 at an opposed end. The soffits 302 optionally conceal portions of the fenestration assembly 100, such as the underside of the carriage frame 202. In another example, insulation panels, utility components (service ducts 216, wiring or the like) are concealed with the soffits 302.

In the example shown in FIG. 4B, interior fascia 300 is provided along one or more of the window shell 204 and the carriage frame 202 along interior surfaces, for instance at the interfaces between component translucent panels 206 with the shell frame 208 and carriage frame 202. In the example shown in FIG. 4B, the interior fascia 300 is coupled with the shell frame 208 (e.g., the component frame 400 of a component window) and extends over the frame 208 as well as a portion of the carriage tray 210, such as the tray member in FIG. 4B. Fittings, such as clips, projections, recesses or the like, are provided with one or more of the interior fascia 300 and the shell frame 208 to couple the fascia 300 to the window shell 204. The fascia 300, in this example, extends over portions of the shell frame 208 and the carriage frame 202. The interior fascia optionally has a corresponding appearance to the match other components of the projecting fenestration assembly 100. Optionally, the interior fascia 300 provides a contrasting or complementary appearance relative to other interior (or exterior) components to enhance aesthetics. In various examples color, finish, contour or the like of the interior fascia 300 provide a specified aesthetic for the fascia 300 relative to the remainder of the assembly 100.

In still other examples, the interior fascia 300 cooperates with one or more components of the projecting fenestration assembly 100 in a functional manner. For instance, as previously described herein the service ducts 216 provide one or more ventilation, wiring or the like. In an example including ventilation the service ducts 216 are in communication with other components of the assembly 100 to distribute ventilation. In one example, the interior fascia 300 includes passages in communication with the service ducts 216 to distribute ventilation through the projecting fenestration assembly 100, for example to vents provided along the fascia 300 or other components in communication with the passages of the fascia 300. In other examples, wiring (e.g., power, data or the like) is provided through one or more of the service ducts 216 or the interior fascia 300 and coupled with one or more light modulating elements, such as light arrays, shades or the like to facilitate operation proximate to the assembly 100.

Figure 5:
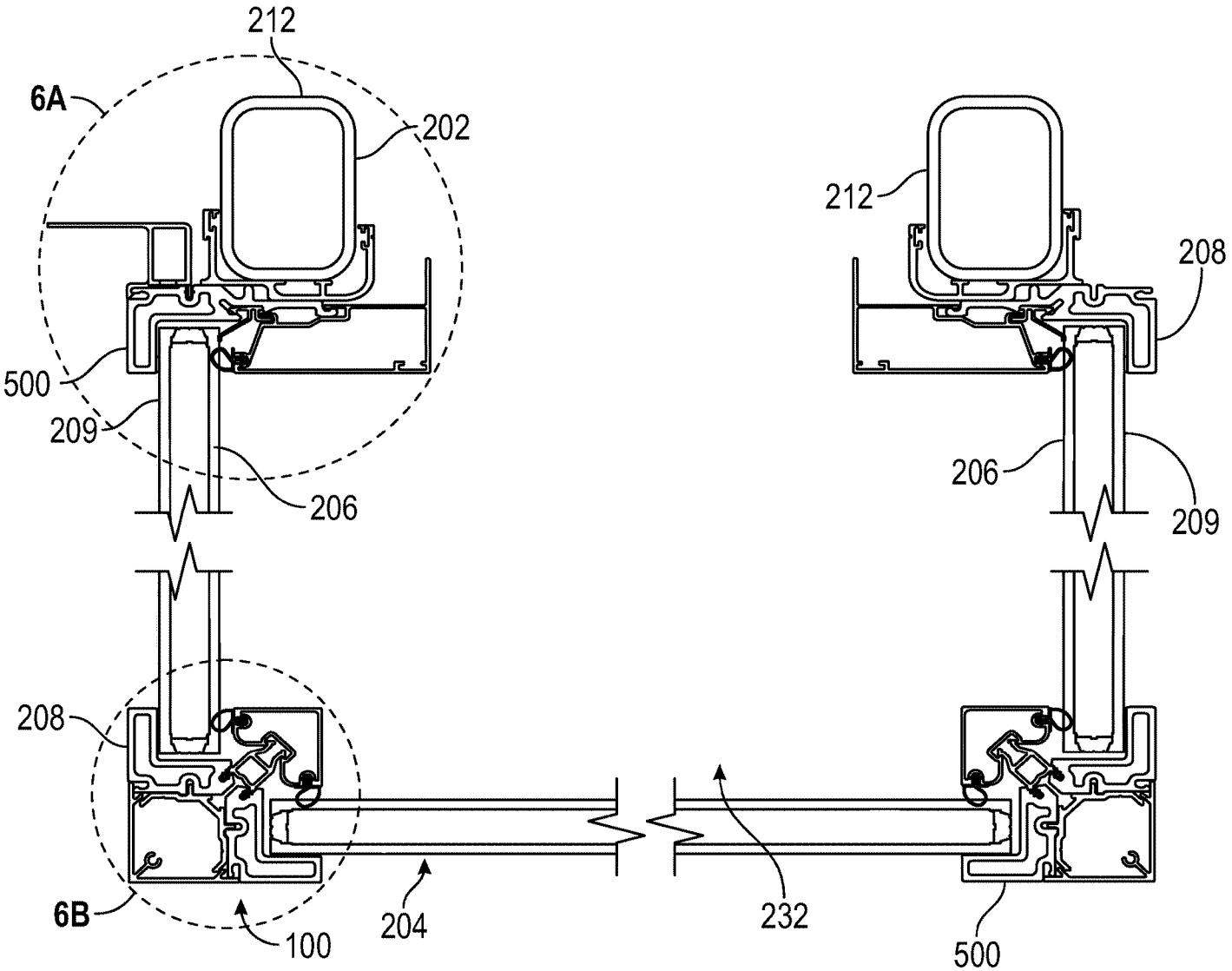
FIG. 5 is another cross sectional view of the projecting fenestration assembly of FIG. 1.

FIG. 5 is a cross-sectional view of the projecting fenestration assembly 100 taken along a horizontal line through the assembly 100. As shown, the projecting fenestration assembly 100 includes a window shell 204 coupled with the carriage frame 202. As previously described, the carriage frame 202 includes one or more carriage struts 212, for instance opposing carriage struts 212, provided on either side of the projecting fenestration assembly 100. The carriage struts 212 couple with the carriage tray 210 shown in FIGS. 2 and 3. As further shown in FIG. 5, the window shell 204 is coupled with the carriage frame 202. The window shell 204 includes a shell frame 208, for instance, provided between the component translucent panels 206. In another example, the window shell 204 includes one or more component windows 209. Each of the component windows 209 includes an associated component translucent panel 206 coupled with an associated component frame 500 (a portion of the shell frame 208) of the window shell 204. As shown in FIG. 5, the component frames 500 are assembled to form the shell frame 208 and the window shell 204.

As further shown in FIG. 5, the window shell 204, coupled with the component frame 500, surrounds a light cavity 232. The light cavity 232 receives ambient (exterior) light therein and opens associated interior spaces of a building to create an impression of incorporation of the exterior environment. For instance, the light cavity 232 is a projecting portion of the assembly 100 relative to the rough opening that extends from the building and receives ambient light through multiple component translucent panels 206 in contrast a panel associated with previous windows that extend across the rough opening, such as double hung windows.

Figure 6A:
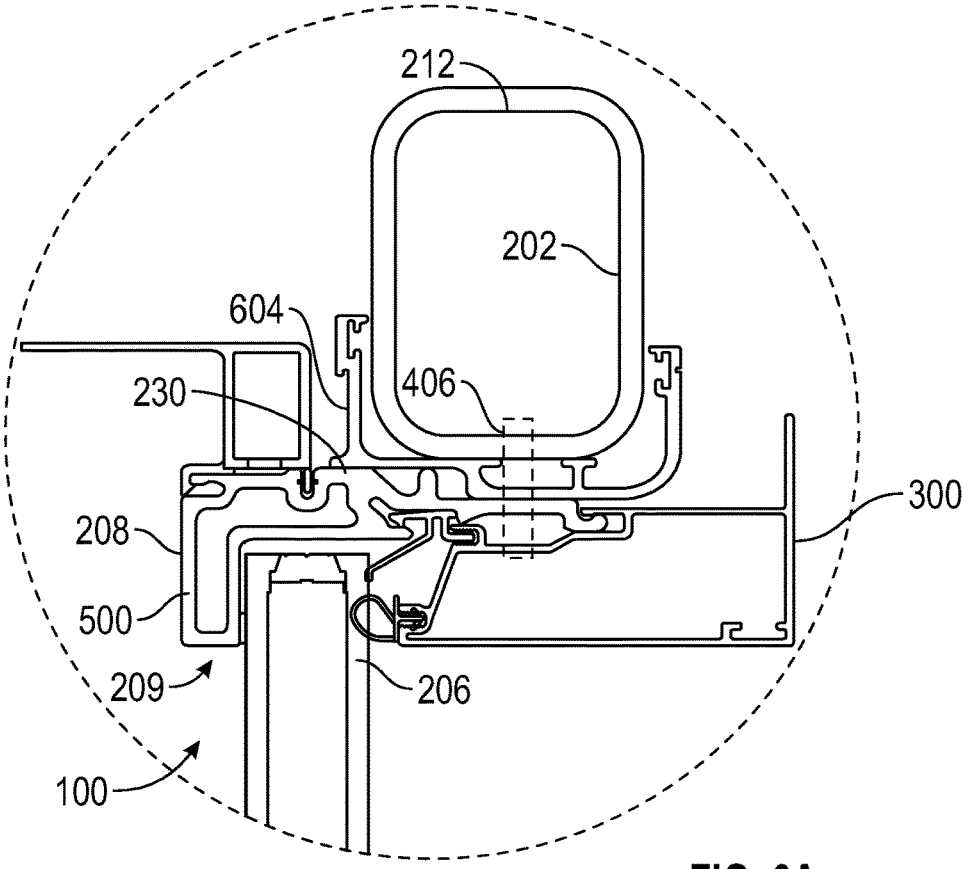
FIG. 6A is a detailed cross sectional view of a portion of the projecting fenestration assembly shown in FIG. 5.

Referring now to FIG. 6A, a detailed cross-sectional view of a portion of the projecting fenestration assembly 100 is shown. The cross-sectional view shown in FIG. 6A is similar in some regards to the cross-sectional view shown and discussed previously in FIG. 4B. For instance, the carriage frame 202 is shown extending into and out of the page. In this example, the carriage frame 202 includes one of the carriage struts 212 configured to extend along a corresponding portion of the rough opening frame when installed to a building. The carriage strut 212 of the carriage frame 202 is coupled with the window shell, for instance, a shell frame 208 of the window shell 204.

As shown in FIG. 6A, the shell frame 208 includes a socket 604 configured to receive a portion of the carriage frame 202, such as the carriage strut 212 therein. In a similar manner to the previously described socket 404 shown in FIG. 4B, the socket 604 shown in FIG. 6A has a corresponding profile to the carriage strut 212. In another example, the socket 604 includes one or more features configured to enhance the coupling between the carriage strut 212 and the shell frame 208. For instance, a gasket, seal, weld, adhesive, fitting or the like is provided with the socket 604 (or strut 212) and correspondingly received or interfit with a feature of the carriage strut 212 (or socket 604) to thereby facilitate an enhanced robust coupling between the carriage strut 212 and the shell frame 208. In the example shown in FIG. 6A, the socket 604 is provided in this example along a shell edge 230 of the window shell 204. In another example, a component frame 500 of the shell frame 208 includes the socket 604. As further shown, an optional fastener 406 extends through the component frame 500 and into the carriage strut 212 to accordingly fasten the carriage strut 212 with the remainder of the window shell such as the component frame 500. The fastener 406 includes, but is not limited to, a screw, stud, pin, post or the like received with or coupled with corresponding features of the carriage strut 212 and the component frame 500.

As previously described, coupling of the carriage strut 212 with the socket 604, in one example, couples the carriage frame 202 (for instance the shell edge 230) with the window shell 204 and aligns the carriage frame 202 with the window shell 204. Accordingly, once assembled, the window shell 204 is aligned with the carriage frame 202 during assembly, transport, installation and for the lifetime of the fenestration assembly 100. For example, the socket 604 extends along the shell frame 208 continuously, and reception of the carriage strut 212 within the socket 604 aligns the strut 212 with the window shell 204 including the portion of the shell frame 208 having the socket. In another example, the socket 604 includes component sockets at two or more locations along the shell frame 208 that are spaced apart to cooperatively align the carriage strut 212 received therein to the window shell 204.

As further shown in FIG. 6A, an optional interior fascia 300 is coupled with the shell frame 208, for instance with the component frame 500, and conceals or obscures one or more features of the component frame 500, window shell 204, carriage frame 202 or the like. For instance, as shown, the interior fascia 300 extends across components of the shell frame 208 and corresponding components of the carriage frame 202 including, for instance, the carriage strut 212. The interior fascia 300 as previously described and shown herein includes one or more decorative or aesthetic features, for instance, finish, paint, contours or the like configured to provide an aesthetic appearance to the projecting fenestration assembly 100 at the interface with the component translucent panel 206 and overlying one or more functional components, such as the shell frame 208 and carriage strut 212.

In another example, the interior fascia 300 provides interior passages, lumens, ducts or the like for the reception and distribution of ventilation, power or other utilities around the projecting fenestration assembly 100. For instance, in one example, the interior fascia 300 includes one or more of vents, ports, ducts, louvers or the like configured to distribution ventilation into the light cavity 232 of the projecting fenestration assembly 100. In another example, the interior fascia 300 includes ports or recesses sized and shaped to receive a lighting array or other light modulating element such as an operable shade therein. In one example, the interior fascia 300 include power or control wiring extending to light modulating elements such as an operable shades, light arrays or the like coupled with the interior fascia 300 or coupled with the projecting fenestration assembly 100.

Figure 6B:
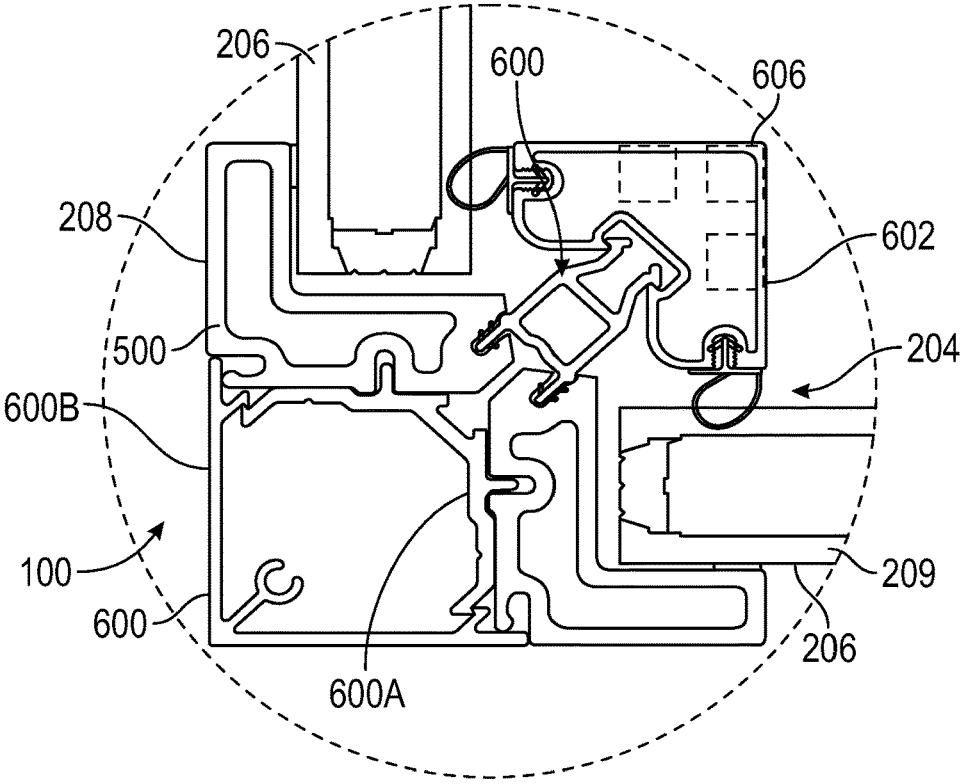
FIG. 6B is another detailed cross sectional view of a portion of the projecting fenestration assembly shown in FIG. 5.

Referring now to FIG. 6B, another portion of the projecting fenestration assembly is shown. In this example, the portion shown corresponds to a corner or similar feature of the fenestration assembly 100 previously shown in FIG. 5. The portion of the projecting fenestration assembly 100 includes a shell frame 208 coupled with component translucent panels 206. For instance, the shell frame 208, as previously described herein, optionally includes component frames 500 associated with each of the component translucent panels 206 (in the manner of component windows).

As further shown in FIG. 6B, an interior fascia 602, such as a lineal element including one or more of an aesthetic finish, paint, contour or the like, is coupled between the component translucent panels 206, for instance, with one or more mullion members 600 also shown in FIG. 6B. The example shown in FIG. 6B includes interior and exterior mullion members 600. As further shown in FIG. 6B, the exterior based mullion member 600 is provided along the component frames 500 associated with each of the component translucent panels 206. The mullion member 600, in a similar manner to the interior fascia 602, optionally includes a decorative finish, paint, contour or the like that provides aesthetic features to the mullion member 600 that correspond with (e.g., matches, enhances or the like) the aesthetic of the shell frame 208. For instance, the mullion member 600 includes an aesthetic finish, paint, contour or the like that corresponds with the shell frame 208 or enhances the appearance of the shell frame 208.

As shown in FIG. 6B, the mullion member 600 proximate the exterior of the projecting fenestration assembly 100 is coupled between the component frames 500 of the associated panels 206 with one or more complimentary fittings, such as recesses, grooves, clips or the like. In one example, the mullion member 600 is snapped into place between the component frames 500 and accordingly interfits the component frames 500 and, in one example, aligns the component frames 500 and the component translucent panels 206 coupled with the component frames 500 to form the window shell 204. Optionally, the exterior mullion member includes two or more component portions interfit with each other, and as shown in FIG. 6B. The first portion 600A is coupled with the proximate component frames 500, for instance with complimentary fittings. The second portion 600B in this example includes one or more aesthetic features, such as finish, paint, contour or the like, and is coupled with the first portion 600A for instance with deflection of the second portion 600B during fitting to the first portion 600A to provide a clamping or clipped coupling.

In a similar example, the interior mullion member 600 provided proximate the interior of the window shell 204, for instance, coupled with the interior fascia 602, is similarly coupled between the component frames 500 with fittings such as projections, recesses, grooves or the like. The interior mullion member 600 couples the panels 206 (and frames) together and aligns the panels 206 to form the window shell 204. In this example, the mullion member 600 provided along an interior portion of the projecting fenestration assembly 100 further includes one or more features for coupling with the interior fascia 602. For instance, as shown in FIG. 6B, fittings are provided between each of the interior fascia 602 and the interior mullion member 600, such as deflectable flanges or the like, to couple the interior fascia 602 with the mullion member 600. Optionally, the interior fascia 602, mullion member 600 or the like includes one or more deflectable features such as weather stripping, gaskets or the like configured to engage with proximate components of the window shell 204 and provide a seal therebetween.

As further shown in FIG. 6B, in one example one or more light modulating elements are provided with components of the projecting fenestration assembly 100. In this example, a lighting array 606 is provided as one example of the light modulating element. As shown in FIG. 6B, the lighting array 606 optionally includes a one or more light elements, such as LEDs, florescent bulbs, tubes or the like, provided within the interior fascia 602 and configured to directly or indirectly provide lighting to the light cavity 232 as well as the interior of the associated building. In some examples, the lighting array 606 is dimmable (e.g., manually or automatically) and modulated throughout the day to provide supplemental light to the interior of the building or the light cavity 232 in a manner that approximates daylight. For instance, the lighting array 606 is gradually brightened as a specified 'morning' approaches and gradually dimmed as a specified 'evening' approaches. In one example, the light array 606 is operated automatically in combination with a controller and a light level sensor to provide a specified light characteristic (e.g., one or more of brightness, color or the like alone or in combination with the ambient light). The occupant of the building operates the lighting array 606, in another example, to supplement natural daylight and accordingly provide a specified day/night period or brightness (to offset weather conditions) or the like. The lighting arrays 606 are optionally provided in one or more orientations to provide direct or indirect lighting to one or more of the light cavity 232 or the building interior.

The lighting array 606 is one example of a light modulation element. Other examples of light modulation elements include, but are not limited to, shades (e.g., translucent shades, room darkening shades, louvers, screens or the like) used in a converse manner, for instance, to dim ambient light from the light cavity to provide a specified light characteristic (e.g., brightness, color or the like) to the light cavity 232 or the building, for instance, for a dimmed environment within the building.

Figure 7:
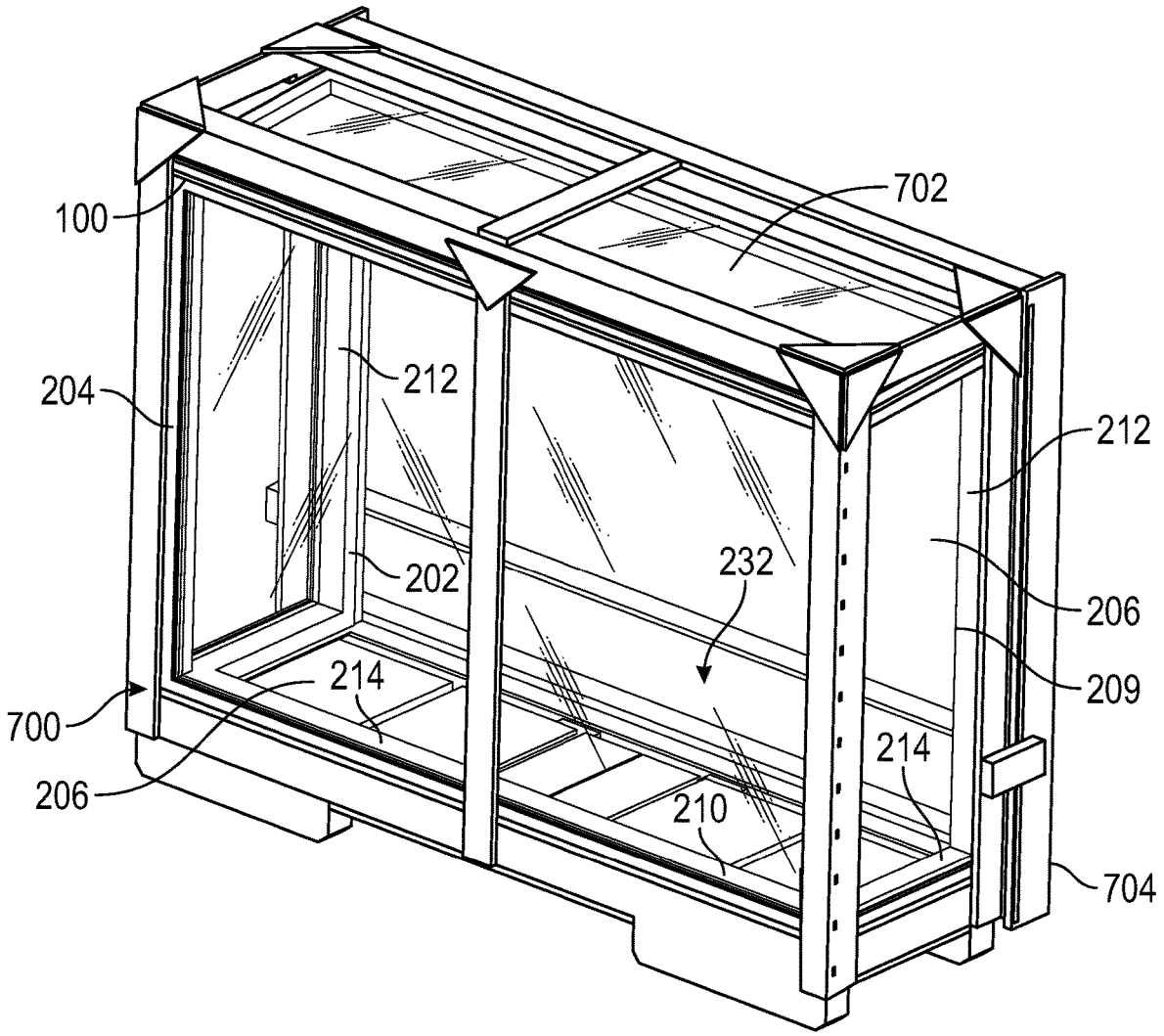
FIG. 7 is a perspective view of another example of a projecting fenestration assembly in an assembled configuration decoupled from a building and ready for installation to the building.

FIG. 7 is a perspective view of the projecting fenestration assembly 100 in a decoupled configuration 700 relative to a rough opening, while assembled as a unit. In this configuration, the window shell 204 and the carriage frame 202 are assembled and ready for installation. For instance, the window shell 204 and carriage frame 202 are ready for installation as a unit to a rough opening as shown in FIG. 1. The projecting fenestration assembly 100 in the decoupled configuration remains assembled from the decoupled configuration to the installed configuration and accordingly onsite assembly, construction of frame, boxes, headers, supports or the like used in other projecting fenestration units are minimized (e.g., reduced or eliminated). Instead, and in one example, the projecting fenestration assembly 100 is provided assembled from the factory, manufacturer or the like as shown in FIG. 7. For example, the assembly 100 in the decoupled configuration is provided in a packing enclosure 704 when delivered to a work site.

As shown in FIG. 7, the projecting fenestration assembly 100 includes the window shell 204 coupled with the carriage frame 202. As shown, and as previously described, the window shell 204 includes component translucent panels 206 secured within the window shell 204, for instance, with a shell frame 208 (e.g., with one or more component frames). As further shown in FIG. 7, the window shell 204 optionally includes a canopy translucent panel 702. In one example, the canopy translucent panel 702 is similar, in at least some regards, to the component translucent panel 206. For instance, the canopy translucent panel 702 includes an associated component frame as part of the carriage frame 202. In another example, instead of the canopy translucent panel 702, an opaque panel is provided in place of the translucent panel 702 and the opaque panel is formed as a part of the carriage frame 202 or as a separate panel that is installed within the carriage frame 202 associated with the panel 702. As shown in FIGS. 3 and 4A the canopy translucent panel 702 is optionally sloped to facilitate the diversion of moisture away from the building and from the assembly 100.

As further shown in FIG. 7, the window shell 204 in the decoupled configuration 700 comes assembled with the carriage frame 202. As previously described, the carriage frame 202 optionally includes a carriage tray 210 extending from carriage struts 212. The carriage struts 212 cooperate with the carriage tray 210 to support the projecting fenestration assembly 100 in a compact profile (e.g., a profile including the combined carriage profile and shell profiles). In this example assembly 100, the load (e.g., forces, moments or the like) of the window shell 204 is received with one or more of the carriage tray 210 and the carriage struts 212. The load generated by the tray 210 and the window shell 204 are transferred to the carriage struts 212 as described herein. The load of the assembly 100 is distributed into the carriage frame, for instance, to the carriage struts 212 for distribution into the rough opening frame of the building. The load distribution and support from the window shell 204, to the carriage frame 202 and through the frame 202 to the associated building facilitate the compact profile of the fenestration assembly 100. As described herein, the carriage and shell profiles 222, 224 are, in one example, corresponding, for instance, the carriage profile 222 is included within the shell profile 224 (e.g. coextensive or nearly coextensive) to provide a compact projecting fenestration assembly 100 while minimizing framing, supports, hangers or the like built around previous window assemblies, such as bay windows, projecting windows or the like.

Figure 8A:
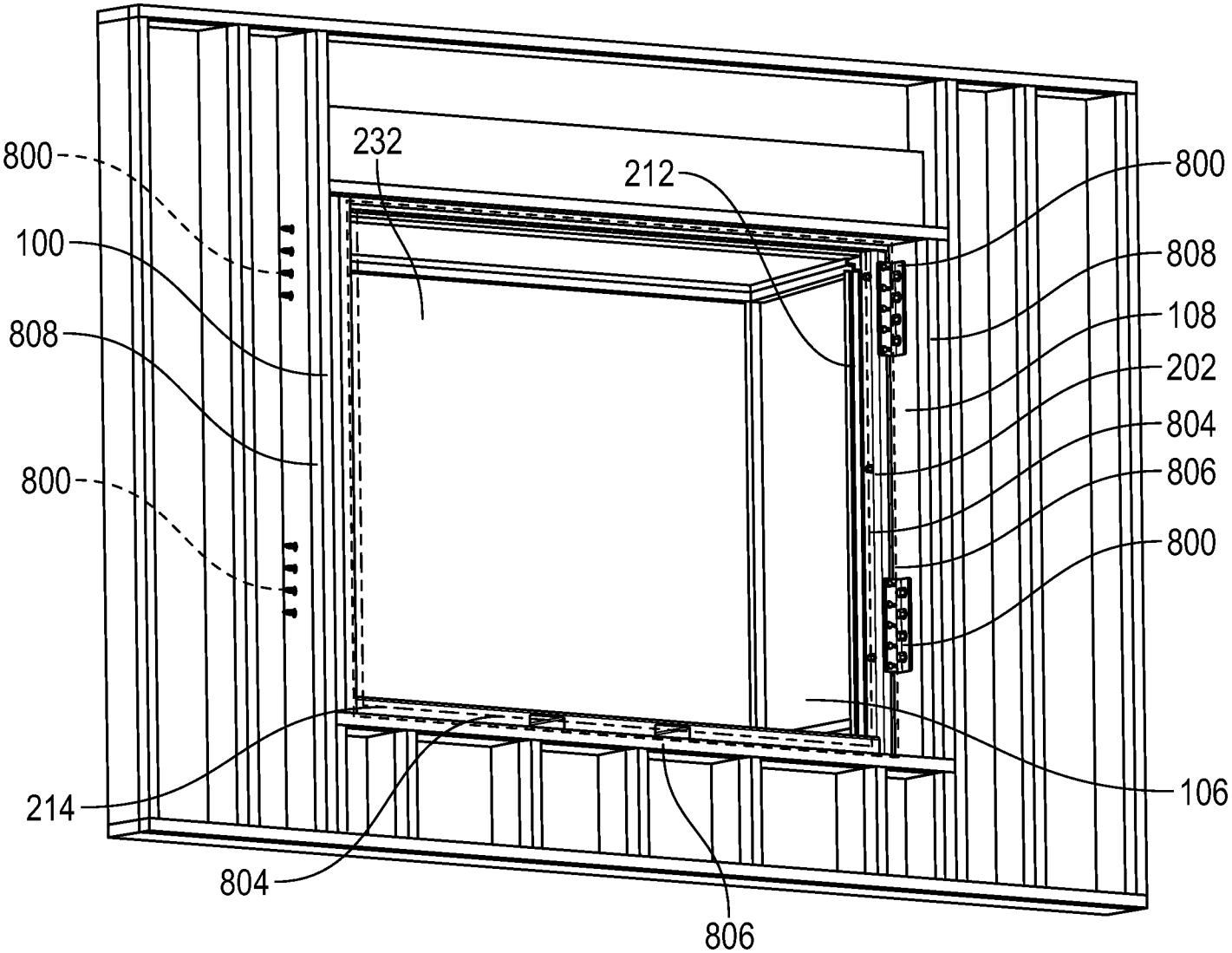
FIG. 8A is a perspective of the projecting fenestration assembly of FIG. 7 in the assembled configuration and in an installed configuration.

FIG. 8A is a perspective view of the projecting fenestration assembly 100 in an installed configuration, for instance, along a wall having the rough opening 106. As shown, the rough opening 106 includes a rough opening frame 108 including one or more of studs, support members or the like extending around the rough opening 106. As previously described, the projecting fenestration assembly 100 includes a carriage frame 202 and the carriage frame, for instance including the carriage struts 212, is coupled with the rough opening frame 108. As shown in FIG. 8A, one or more anchor brackets 800 are provided between the carriage struts 212 and the rough opening frame 108 to couple the projecting fenestration assembly 100 to the rough opening frame 108 and facilitate the transmission and distribution of loads from the projecting fenestration assembly 100 to the rough opening frame 108 without using associated frame boxes, hangers, support assemblies or the like that otherwise increase the overall profile of the projecting fenestration assembly 100.

As further shown in FIG. 8A, the projecting fenestration assembly 100 further includes an assembly profile 804 shown in broken lines extending along the rough opening 106 (e.g., corresponding to a rough opening profile 806 shown with a broken line with different stippling in FIG. 8A). The assembly profile 804 of the projecting fenestration assembly 100 corresponds to the rough opening profile 806, for instance, by way of size or shape of the rough opening 106. The assembly profile 804, in this example, includes each of the shell profile 224 and the carriage profile 222 previously described herein. In one example, the assembly profile 804 corresponds to the shell profile 224 and the shell profile 224 in turn corresponds to the carriage profile 222. For instance, the assembly profile 804 is based on the carriage profile 222 corresponding with the shell profile 224 (e.g., coextensive, matching, identical or the like). The assembly 100 with the assembly profile 804 corresponds to the rough opening profile 806 and protrudes from the building appears to 'float' without box frames, angle frames, supports, hangers or the like built around the assembly 100 (as shown in FIG. 1 from the exterior).

As described herein, the projecting fenestration assembly 100 is provided in the assembled and decoupled configuration shown previously in FIG. 7. For instance, the carriage frame 202, shown in FIG. 8A, is provided coupled with the window shell 204. In the decoupled configuration, the projecting fenestration assembly 100 is positioned at the rough opening 106 having the rough opening frame 108 and is coupled in place, for instance, with the anchor brackets 800 as described herein. In contrast with other projecting fenestration assemblies, the assembly 100, shown in FIG. 8A and previously described and shown in FIG. 7, is provided in an assembled configuration for immediate installation to the rough opening 106. Time consuming and labor-intensive assembly of multiple component windows, building of support frames, hangers and the like, that may otherwise increase the overall profile of a projecting fenestration assembly are thereby avoided. Instead, the projecting fenestration assembly 100 is provided in an assembled or near fully assembled configuration for immediate installation to the rough opening 106.

Figure 8B:
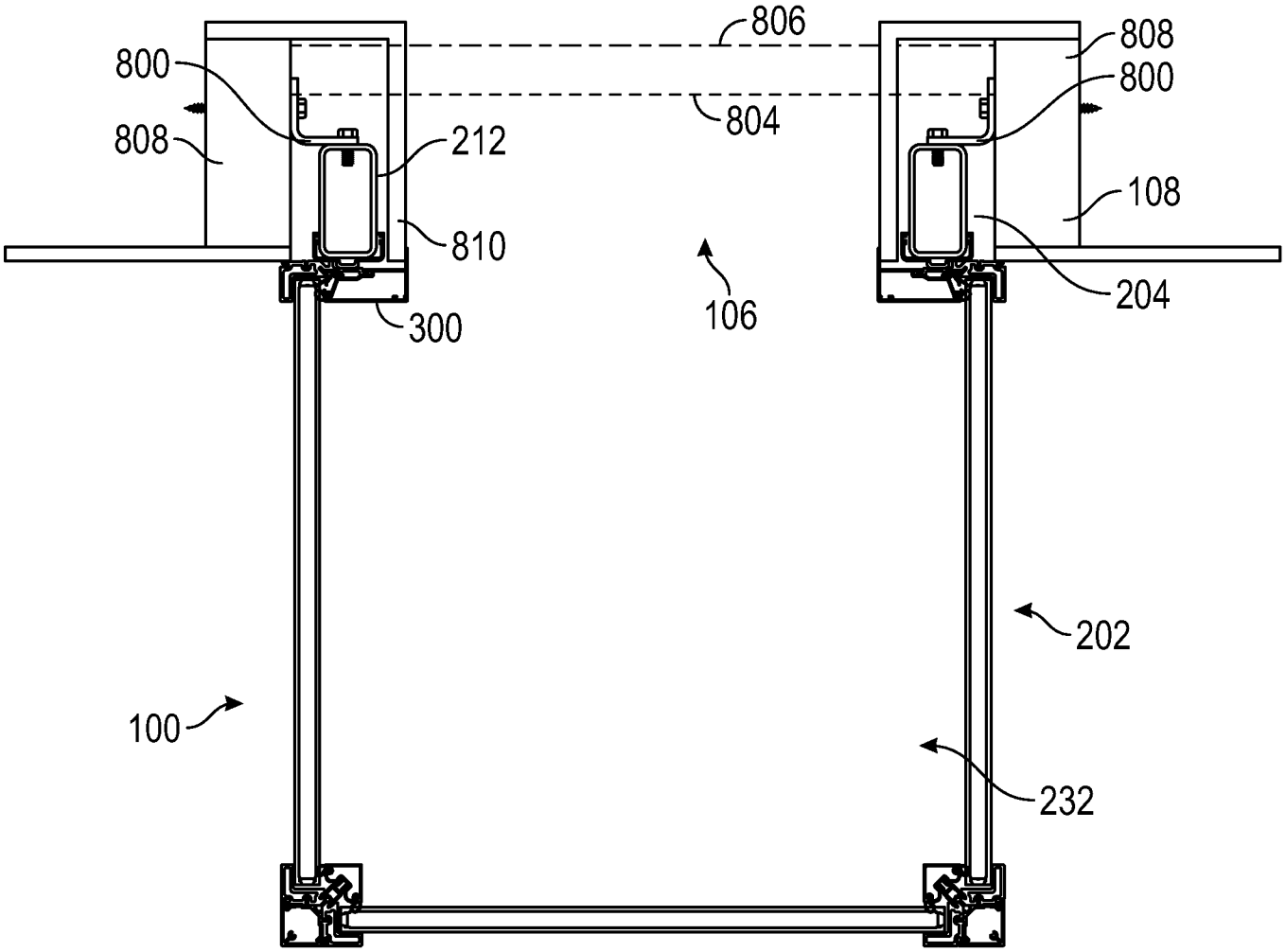
FIG. 8B is a cross sectional view of the projecting fenestration assembly of FIG. 8A in the installed configuration.

FIG. 8B is a cross-sectional view of the projecting fenestration assembly 100 in the installed configuration coupled with the rough opening frame 108. As shown in FIG. 8B, the anchor brackets 800 are coupled between the upright members 808 of the rough opening frame 108 with one or more anchor brackets 800. In another example, the carriage frame 204 is directly coupled with the upright members 808, for instance, with one or more bolts, fasteners or the like configured to extend between the upright members 808 and the carriage frame 204 such as the carriage struts 212. As shown in FIG. 8B, the anchor brackets 800, in this example, include L-brackets that interface the carriage frame 204 with the rough opening frame 108 of the rough opening 106. Optionally, the anchor brackets 800 facilitate the distribution of load such as force, moment (including occupant weight for the seat) or the like from the fenestration assembly 100 to the carriage struts 212 into the rough opening frame 108. The anchor brackets 800 optionally enhance the robust coupling between the assembly 100 and the building. In one example, the anchor brackets 800 are preinstalled on the carriage struts 212 and positioned in the rough opening frame 108 with installation of the projecting fenestration assembly 100. For instance, the anchor brackets 800 are welded to, pre-fastened or the like to the carriage struts 212. The portion of the anchor brackets 800 facing the rough opening frame 108 is then fastened to the frame 108 to complete the structural installation of the assembly 100.

As further shown in FIG. 8B, the assembly profile 804 is again shown extending in a first broken line pattern across the rough opening 106. In a similar manner, the rough opening profile 806 also extends across the rough opening 106. As shown, the assembly profile 804 and the rough opening profile 806 correspond (e.g., are coextensive, matching, identical or the like) because of the corresponding carriage and shell profiles 222, 224

Figure 9:
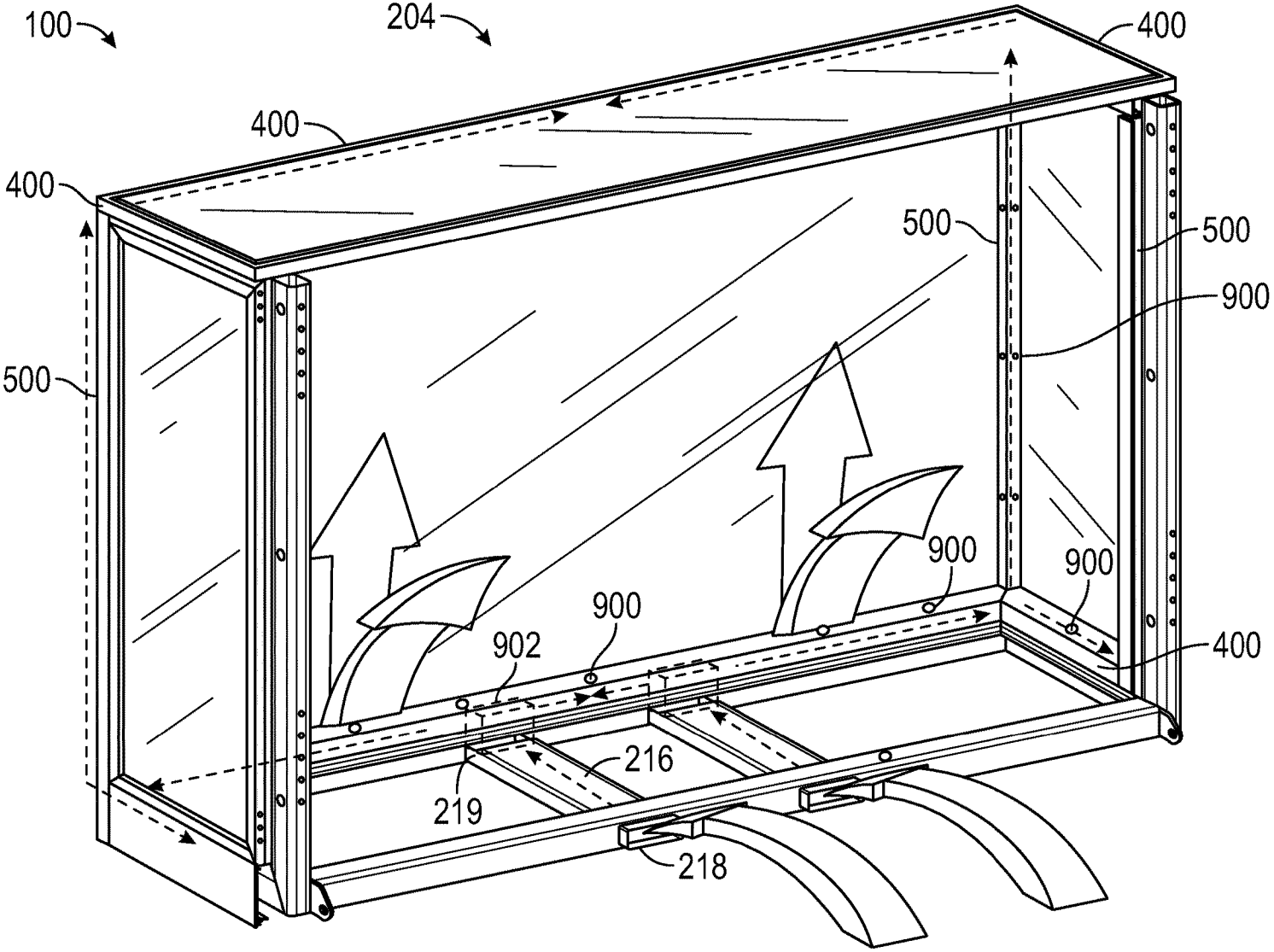
FIG. 9 is a schematic view of an additional example of a projecting fenestration assembly including a service duct and distributed ventilation.

FIG. 9 is a schematic perspective view of the projecting fenestration assembly 100. The projecting fenestration assembly 100 is provided in an assembled configuration, for instance, with the window shell 204 coupled with the carriage frame 202. In this example, the window shell 204 includes a plurality of component windows including associated component frames 400, 500 and component translucent panels 206. The component frames and associated panels 206 are, in one example, assembled into component windows and thereafter assembled, for instance, with mullion members, adhesives, welds or the like into the window shell 204. As shown in FIG. 9, the window shell 204 is coupled with the carriage frame 202 including one or more frame members such as tray members, carriage struts or the like configured to support and correspond with the profile of the window shell 204.

As further shown in FIG. 9, one example of distribution of a utility through the projecting fenestration assembly 100 is shown. In this example, the service ducts 216 and access ports 218 are utilized to distribute ventilation into one or more portions of the projecting fenestration assembly 100. As shown with the illustrative arrows, ventilation is provided through the access ports 218 and delivered through the service ducts 216 for distribution throughout the projecting fenestration assembly 100. As previously described, one or more fascia elements, frame members or the like include lumens, ducts or passages configured to distribute the ventilation through the projecting fenestration assembly 100. In this example, the component frames 400, 500 and the associated service ducts 216 provide ventilation and distribute the ventilation to one or more vents 900 positioned around the component frames 400, 500. In another example, the fascia, such as the interior fascia 300 shown in FIGS. 3, 4B, 6A, are provided with internal passages, lumens, ducts or the like configured to receive ventilation from the service ducts 216 (e.g., with an optional interface fitting 902). In either example, one or more of the interior fascia 300, component frame 400 or component frame 500 include vents 900 (e.g., ports, louvers or the like) configured to distribute the ventilation to the interior of the protruding fenestration assembly 100, for instance, into the light cavity 232.

Figure 10:
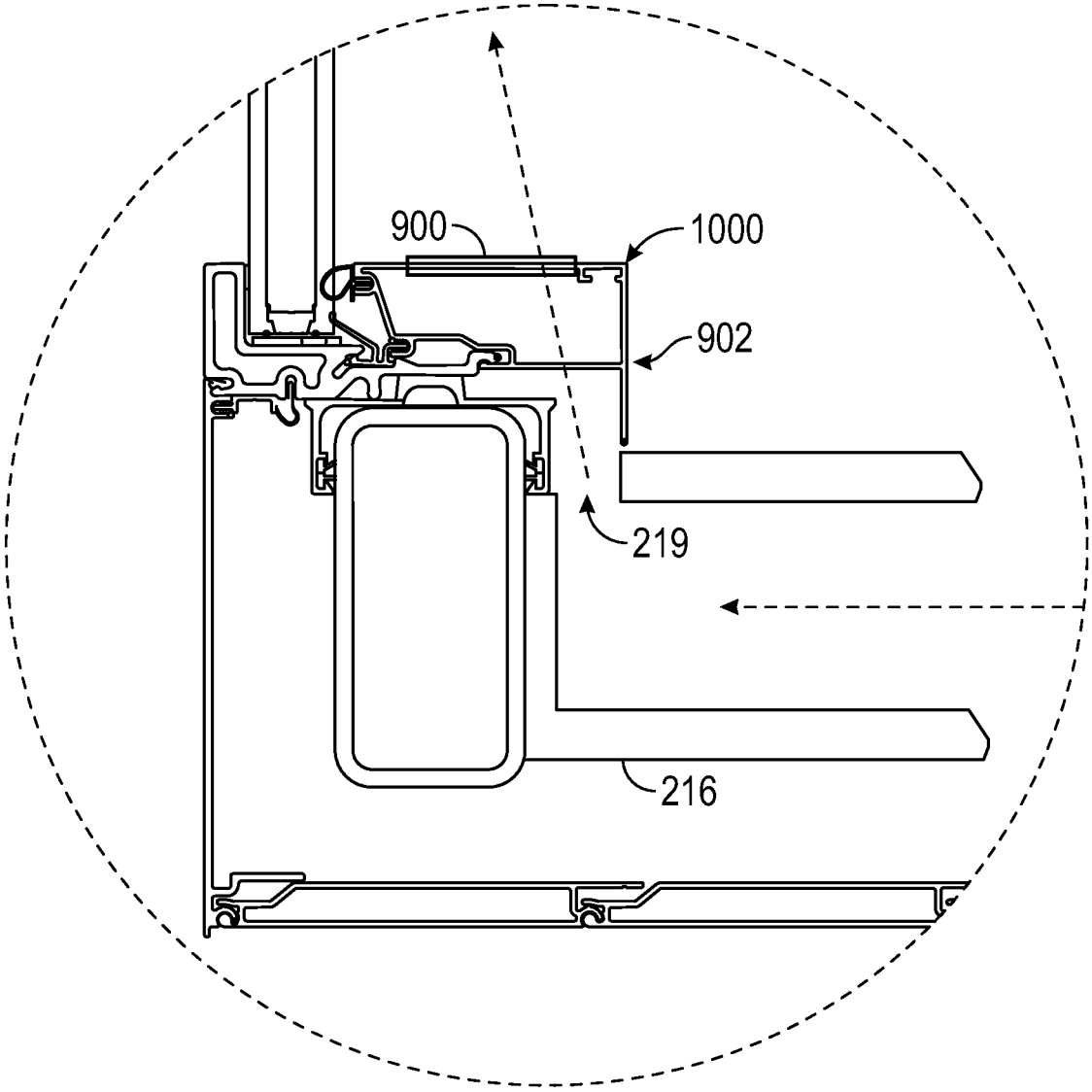
FIG. 10 is a schematic view of the projecting fenestration assembly of FIG. 9 including a distributed ventilation to a vent.

FIG. 10 shows one example of a detailed view of a portion of the projecting fenestration assembly 100 including an example interior fascia element 1000 configured to distribute ventilation from the service ducts 216 into the projecting fenestration assembly 100. In the example shown, the interior fascia 1000 includes the vent 900 that passes ventilation provided from the service duct 216 and the interior fascia 1000 to the interior portions of the projecting fenestration assembly including the light cavity 232. In one example, the service ducts 216 include one or more distribution ports 219 similar to the access ports that are otherwise configured to provide ventilation or access to wiring, cabling or the like proximate to a tray end of the carriage tray of the carriage frame 202. In another example, the interior fascia 1000 includes an interface fitting 902 that interconnects the service ducts 216 with the passage of the interior fascia 1000. The interface fitting 902 is an optional intermediate component that distributes ventilation from the service ducts 216 to the passages of the interior fascia 1000. For instance, the interface fitting 902 is included as a component of the interior fascia 1000 to facilitate delivery of the ventilation into the interior fascia 1000 for eventual distribution from the one or more vents 900. The interface fitting 902 optionally includes ports, passages, perforations or the like in the interior fascia 1000 to facilitate the delivery of ventilated air from the service ducts 216 and into the passages of the interior fascia 1000 for delivery from the vents 900. In another example, the interface fitting 902 is a separate component from the interior fascia 1000 and interconnects the service duct 216 with the passages of the interior fascia 1000.

In another example, the interface fitting 902 communicates ventilation directly to the interior of the assembly 100 (e.g., the light cavity 232) through one or more vents 900. For instance, the interface fitting 902 is a separate component from the interior fascia 1000. In this example, the interface fitting 902 includes the vents 900 and delivers ventilation itself to the assembly interior from the service ducts 216 without the interior fascia 1000 or fascia previously described herein.

Figure 11:
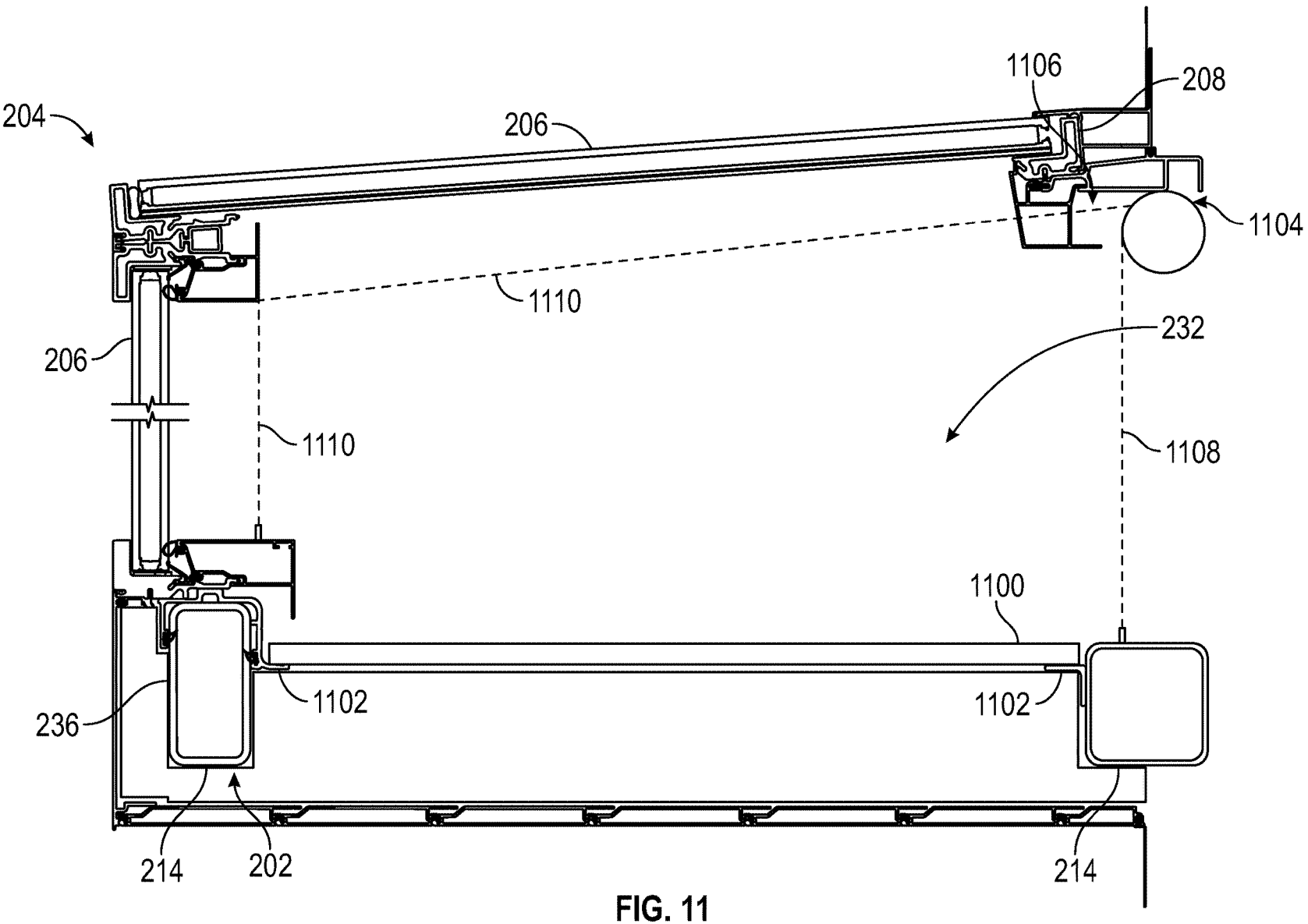
FIG. 11 is a cross sectional view of a supplemental example of projecting fenestration assembly having an onboard window treatment.

FIG. 11 is another cross-sectional view of the projecting fenestration assembly 100. In this example, the projecting fenestration assembly 100 is shown in the installed configuration and includes one or more optional features such as a shade assembly 1104 and seat panel 1100. As first shown in FIG. 11, the seat panel 1100 is optionally coupled with the projecting fenestration assembly 100 with one or more seat flanges 1102 provided with one or more members of the carriage frame 202. As shown in FIG. 11, the seat panel 1100 spans an opening between the seat flanges 1102. Optionally, insulation panels, heating panels or the like are included with or under the seat panel 1100 for environmental control within the light cavity 232. When service of the projecting fenestration assembly 100 is desired, the seat panel 1100 is, in one example, lifted from the seat flanges 1102 or decoupled from the seat flanges 1102 to provide access to the interior of the carriage frame 202.

As further shown in FIG. 11, an optional shade assembly 1104 is provided as another example of a light modulating element having a dimming effect to the other light modulating element described herein, the lighting array 602. In one example, the shade assembly 1104 includes a shade 1108 configured to extend from a shade recess 1106 (e.g., having a spool, magazine or the like) across the proximal opening of the projecting fenestration assembly 100, for instance spanning across the rough opening. In another example, the shade assembly 1104 includes an articulated shade 1110 configured to extend along one or more components of the projecting fenestration assembly including, but not limited to, the component translucent panels 206 shown in FIG. 11, including the vertical translucent panel 206 as well as the upper or canopy translucent panel 206. In one example, the articulated shade 1110 includes one or more slats, articulating panels or the like guided along a track, rails, grooves or the like and configured to articulate relative to each other to facilitate the opening and closing of the shade assembly 1104 into the articulated configuration shown in broken lines in FIG. 11. The track, rails, grooves or the like facilitate the travel of the articulated shade 1110 between the closed position and the open position.

In an open position, the articulated shade 1110 (as well as the shade 1108 where used) are stowed to facilitate the delivery of light through the assembly. For instance, the shades 1110, 1108 are rolled on a spool associated with the shade assembly 1104. In the closed configuration, the articulated shade 1110 is deployed and travels along guides (e.g., rails, slots or the like) provided on the projecting fenestration assembly 100 to articulate the shade 1110 into the closed position shown in broken lines. In a similar manner, the shade 1108 in the closed configuration extends across the rough opening, for instance, from the upper shell frame 208 associated with the carriage frame 202 to the lower tray member 214 of the carriage tray of the carriage frame 202.

In operation, the shades 1108 and the articulated shade 1110 are configured to modulate the delivery of light to the light cavity 232 and the interior of the building associated with the projecting fenestration assembly 100. In some examples, the shades 1108, 1110 are operated automatically with a controller, light level monitor or the like throughout the day to throttle light delivered to the interior of the building through the light cavity 232 in a manner that approximates evening or night conditions. For example, gradual dimming is accomplished as a specified 'evening' approaches with graduated closing of the shades, and gradual retraction of the shades is conducted as a specified 'morning' approaches. In another example, the occupant of the building operates the shades 1108, 1110 of the assembly 100 to throttle natural daylight and accordingly provide a specified dimness (to offset weather or seasonal conditions) or the like. The shades 1108, 1110 of the shade assembly 1104 are one example of a light modulating element. Other examples include other types of shades such as translucent shades, room darkening shades, louvers, screens or the like as well as the lighting arrays 606 described herein.

Figure 12:
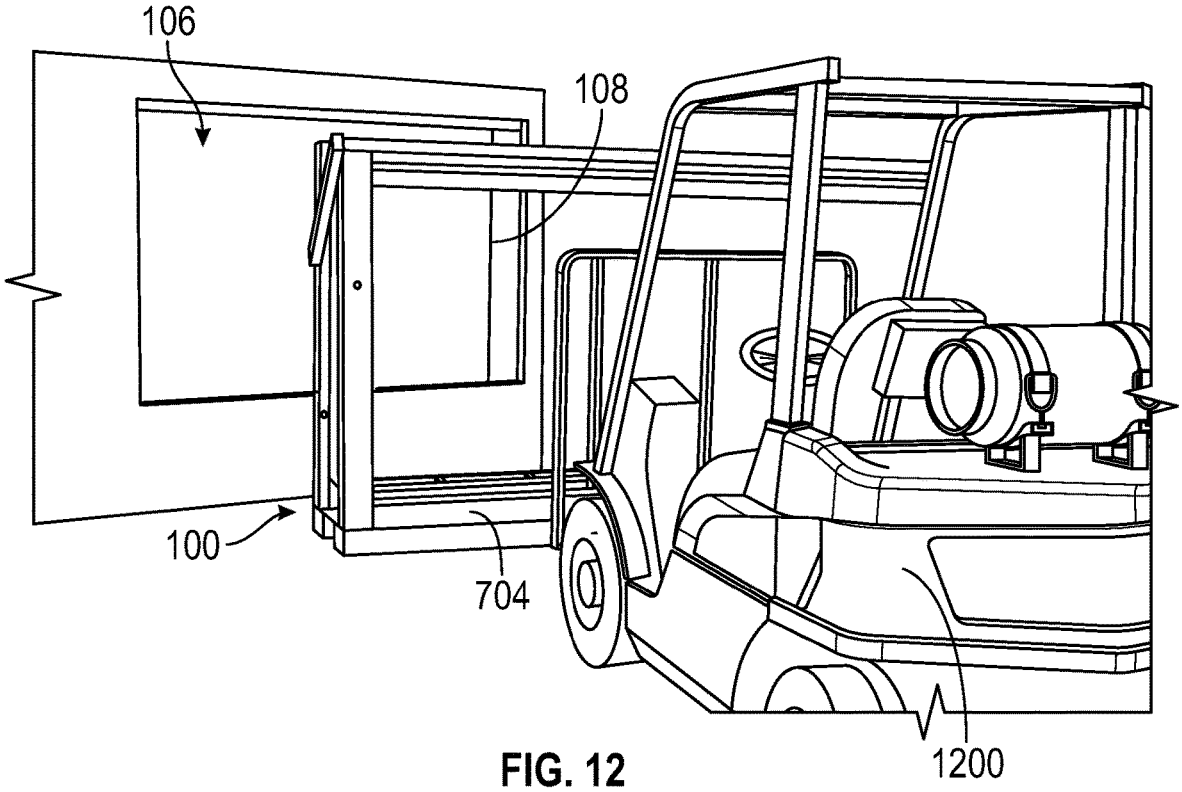
FIG. 12 is a perspective view of another example of the projecting fenestration assembly of FIG. 7 in the assembled configuration lifted toward a rough opening frame.

FIG. 12 shows one example of the initiation of installation of the projecting fenestration assembly 100. As shown, the projecting fenestration assembly 100 is coupled with a lift 1200, for instance, with one or more of the access ports 218 and service ducts 216 shown in FIG. 9. In one example, the lift 1200 includes one or more forks configured to extend through the access ports 218 and service ducts 216 to secure and lift the projecting fenestration assembly 100 toward the rough opening 106 having the rough opening frame 108. Optionally, the projecting fenestration assembly 100 includes the packing enclosure 704. With lifting, for instance with lift 1200, the packing enclosure 704 is removed prior to installation of the projecting fenestration assembly 100 to the rough opening 106. In another example, the packing enclosure 704 remains coupled with the fenestration assembly 100 or is partially removed at installation and then fully removed after initial installation or coupling of the fenestration assembly 100 with the rough opening frame 108.

Figure 13:
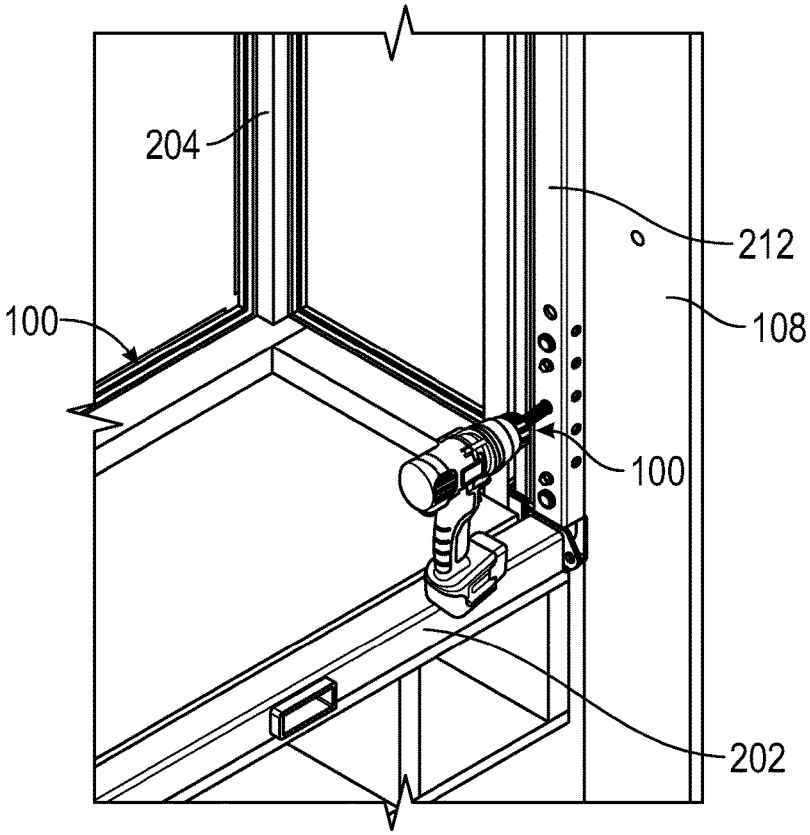
FIG. 13 is a detailed perspective view of the projecting fenestration assembly of FIG. 12 coupled in a hanging configuration with the rough opening frame.

As shown in FIG. 13, the projecting fenestration assembly 100 is in an initially installed configuration relative to the rough opening frame 108. One or more fasteners such as screws, bolts, posts, pins, fittings or the like are fastened through the carriage strut 212 of the carriage frame 202 to initially secure the projecting fenestration assembly 100 to the rough opening frame 108. Optionally, the carriage frame 202 includes tolerance to facilitate fine adjustment of the assembly 100 before anchoring. For instance, the orifices for the fasteners are elongate, channels, or the like to allow adjusting movement for position, plumb, level or the like (e.g., installation characteristics).

As shown in FIG. 13, the window shell 204 is coupled with the carriage frame 202 while the assembly 100 is installed to the rough opening frame 108. Accordingly, a plurality of component windows, support frames or the like are not constructed and installed separately. Instead, the fenestration assembly 100 including the window shell 204 coupled with the carriage frame 202 is installed as a consolidated unit to the rough opening frame 108. In another example, the carriage frame 202 is optionally installed separately from the window shell 204, and the window shell 204 is thereafter installed to the carriage frame 202 to complete the initial installation.

Figure 14:
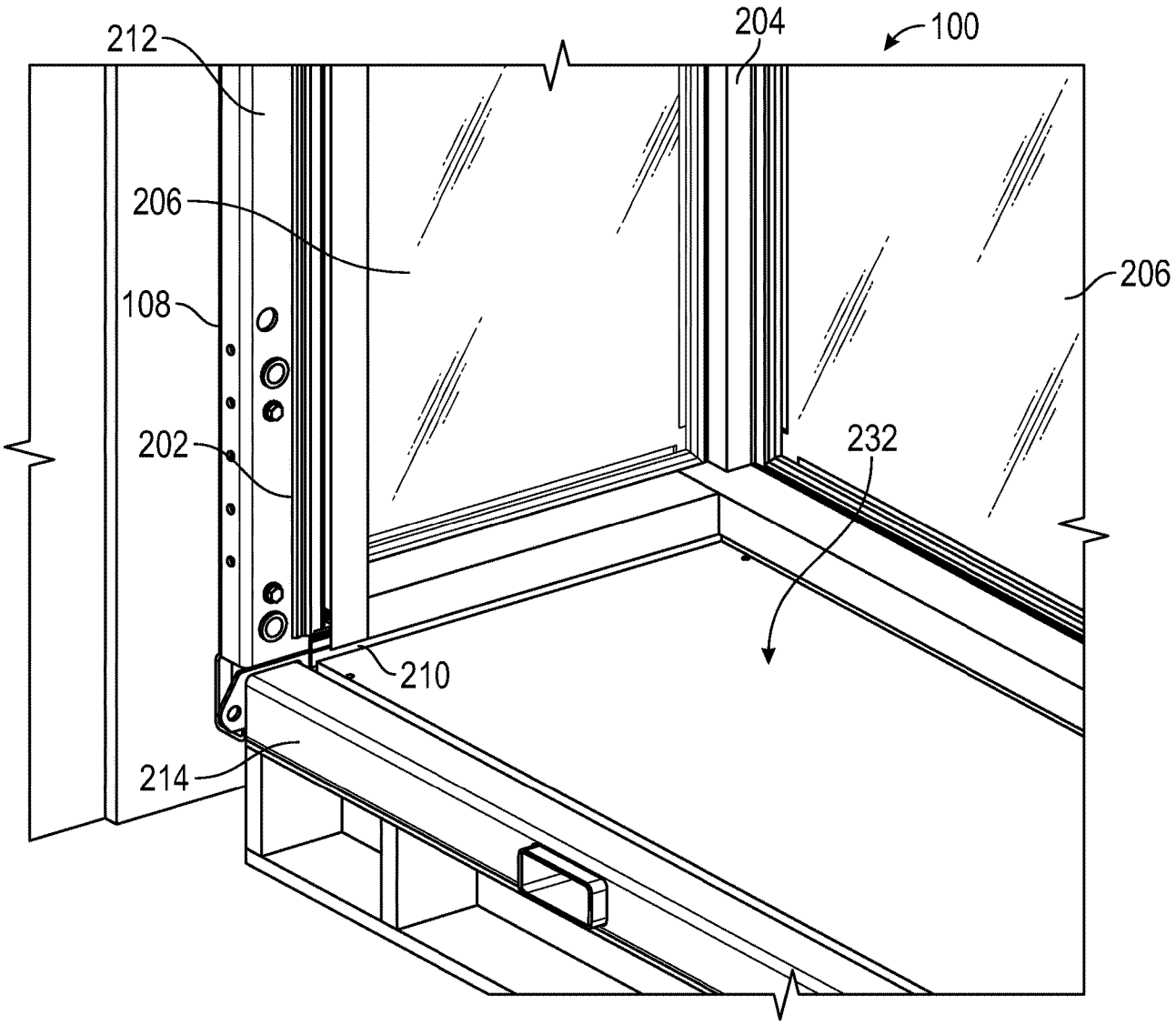
FIG. 14 is a detailed perspective view of the projecting fenestration assembly in the hanging configuration shown in FIG. 13 during adjustment.

FIG. 14 shows another perspective view of the partially installed projecting fenestration assembly 100. In this example, the carriage tray 210 and the carriage struts 212 are positioned within the rough opening 106, for instance, along the rough opening frame 108. The carriage strut 212 shown in FIG. 14 (like the strut 212 in FIG. 13) is initially coupled with a rough opening frame 108, for instance, with one or more fasteners such as bolts, screws and the like. As previously shown in FIG. 13 and described herein, the projecting fenestration assembly 100 is shown in FIG. 14 in an assembled configuration, for instance, with the window shell 204 coupled with the carriage frame 202 and the component translucent panels 206 of the window shell 204 correspondingly coupled with the remainder of the fenestration assembly 100.

In the example shown in FIG. 14, the projecting fenestration assembly 100 is in a partially installed configuration, readily adjustable, for instance, to accordingly plumb, level or the like the installation characteristics of the projecting fenestration assembly 100 prior to anchoring of the fenestration assembly 100 with the rough opening frame 108. In one example, a level, tape measure, plumb bob, or the like are used with the projecting fenestration assembly 100 to check one or more installation characteristics including plumb, level or the like. The installer is thereafter able to gradually adjust the fenestration assembly 100, for instance, with fine adjustments of the assembly 100 using shims, tapping of the assembly 100 with a mallet or the like that cooperate with the initial fasteners to bias the projecting fenestration assembly 100 into a desired installation configuration.

Figure 15A:
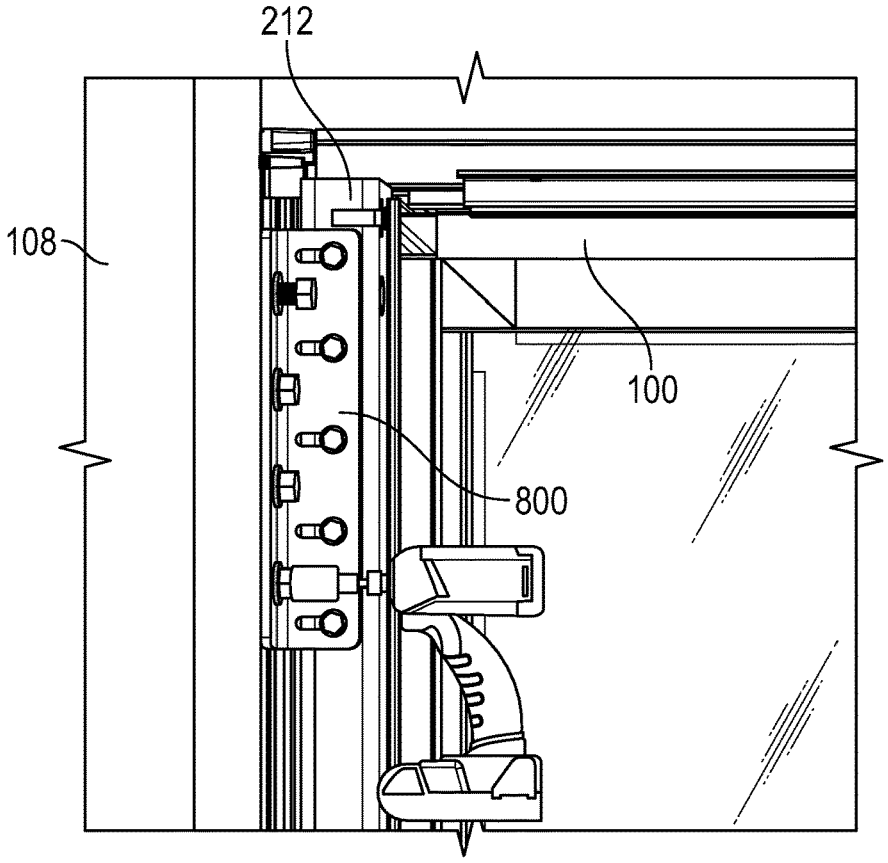
FIG. 15A is a perspective view of the projecting fenestration assembly of FIG. 13 in an installed configuration.
Figure 15B:
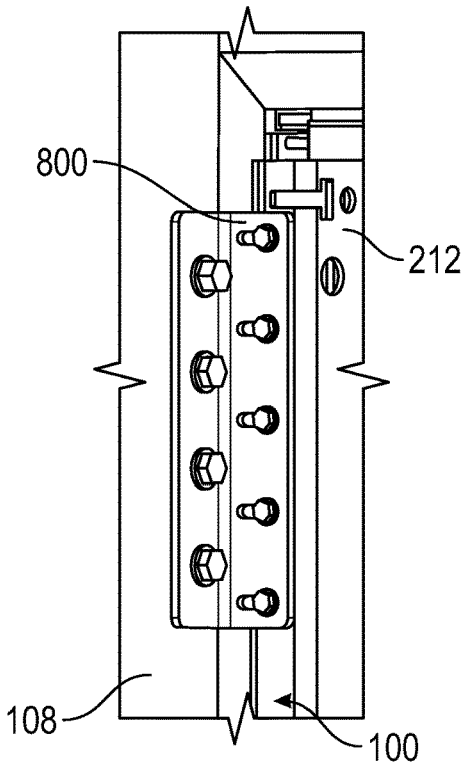
FIG. 15B is a detailed perspective view of the anchor brackets coupled between the projecting fenestration assembly and the rough opening frame.

Referring now to FIGS. 15A and 15B, a portion of the projecting fenestration assembly 100 including the carriage strut 212 is shown in an installed configuration. One example of an anchor bracket 800 is shown in FIGS. 15A and 15B. As shown, the anchor bracket 800 is coupled between the carriage frame 202 (having the carriage strut 212) and the rough opening frame 108. For instance, the anchor bracket 800, in this example, is an L-bracket fastened to the carriage strut 212 of the carriage frame 202. The opposed side of the anchor bracket 800 is coupled with the rough opening frame 108 with one or more fasteners including screws, bolts, fittings, posts, studs or the like configured to couple the anchor bracket 800 with one or more of the rough opening frame 108 or the carriage frame 202. In another example, and as previously described herein, the anchor bracket 800 is optionally welded with the carriage strut 212 to accordingly minimize the number of fasteners used for installation of the fenestration assembly 100 to the rough opening frame 108. With coupling of the fenestration assembly 100 to the rough opening frame 108, for instance, with the anchor brackets 800 the structural coupling of the fenestration assembly 100 to the building is in one example complete. For instance, the fenestration assembly 100, including the window shell 204 and the carriage frame 202, are coupled with the building as a consolidated unit and the anchor brackets 800, in this example, facilitate the coupling of the unit to the building. Accordingly, one or more supplemental supports, hangers, framing or the like are unnecessary as the fenestration assembly 100 is installed to the rough opening frame 108 in a manner that supports the assembly 100 and distributes load from the assembly to the rough opening frame 108.

Figure 16A:
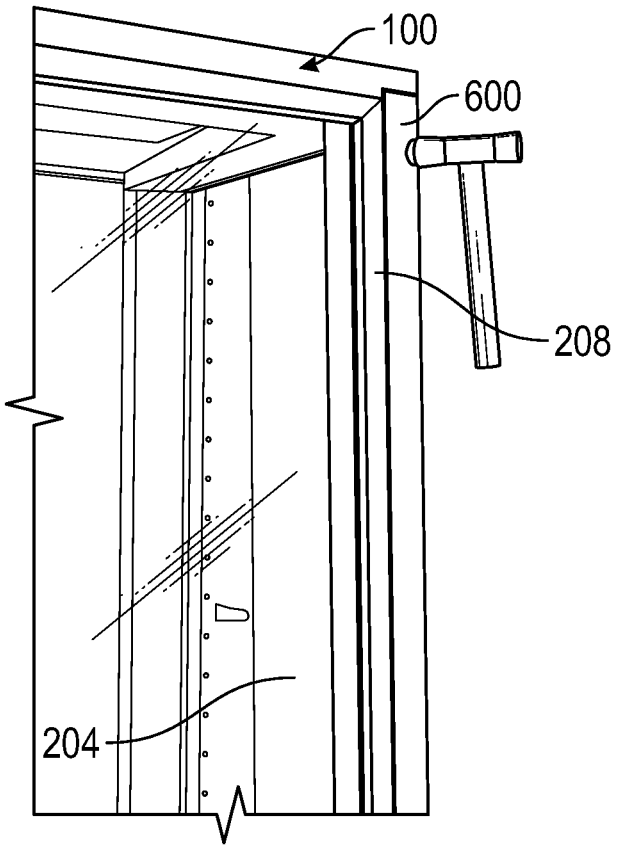
FIG. 16A is a perspective view showing one example of trimming of the projecting fenestration assembly.

FIGS. 16A, B, C show additional examples of installation steps for the fenestration assembly 100 including, optionally, the installation of one or more trim or fascia elements to the fenestration assembly 100. Referring first to FIG. 16A, a portion of the fenestration assembly 100 is shown, including one or more exterior mullion members 600. A rubber mallet, manual manipulation of the exterior mullion member 600 or the like is used to couple the exterior mullion member 600 with one or more other components of the fenestration assembly 100 including, for instance, the shell frame 208 coupled with the mullion member 600. Accordingly, with coupling of the mullion member 600 to the carriage frame 204 one or more aesthetic pieces is coupled with the fenestration assembly 100.

Figure 16B:
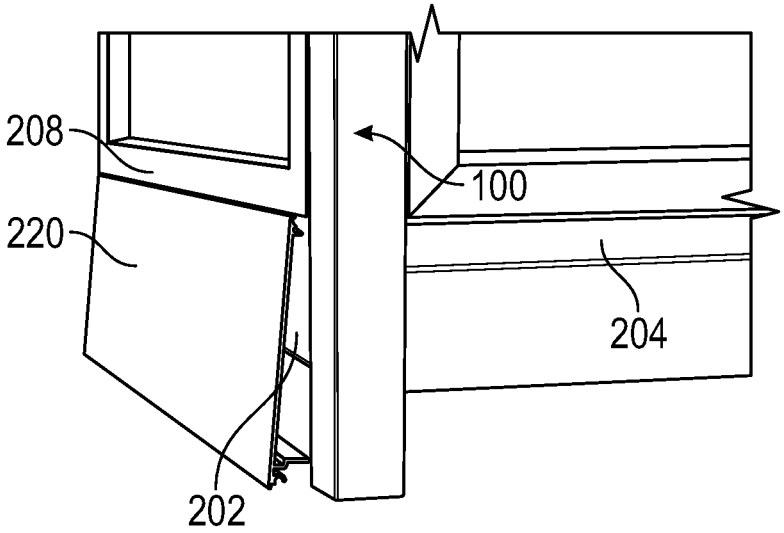
FIG. 16B is a perspective view showing another example of trimming of the projecting fenestration assembly.

FIG. 16B shows another example of installation of a fascia element, such as the fascia 220. As shown, the fascia 220 extends from the shell frame 208 of the window shell 204 and over a component of the carriage frame 202 including, for instance, one or more of the tray members 214. The fascia 220 is previously shown in FIG. 4B. As shown in FIG. 16B, in one example, the fascia 220 is coupled with the fenestration assembly 100, for instance, with a rotating movement to interlock one or more projections, fittings, recesses, grooves or the like with complementary features provided with the shell frame 208 or with one or more other components of the fenestration assembly 100.

Figure 16C:
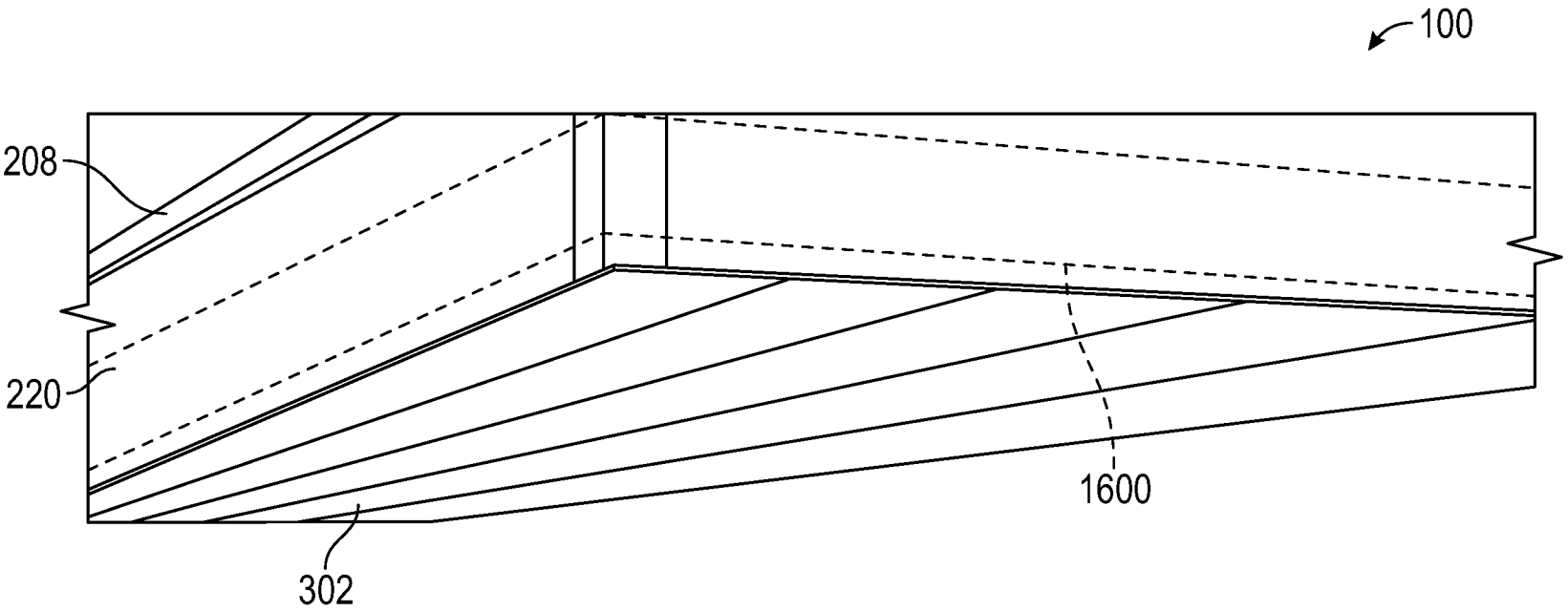
FIG. 16C is a perspective view showing an additional example of trimming of the projecting fenestration assembly.

As shown in FIG. 16C, another example of fascia elements, such as soffits 302, are coupled with the fenestration assembly 100. As previously shown in FIG. 14B, the soffits 302 optionally include multiple panels, slats or the like that are interconnected along the lower portions of the fenestration assembly 100. Optionally, an insulation panel 1600 is installed between the seat panel 1100 (see FIG. 11) and the soffits 302 to provide an insulating feature with the fenestration assembly 100.

Various Notes and Aspects

Aspect 1 can include subject matter such as a projecting fenestration assembly comprising: a window shell having a plurality of component translucent panels, the window shell includes: a shell frame having shell edges and a shell base, the shell frame surrounds a light cavity; the plurality of component translucent panels are seated within the shell frame and surround the light cavity; and a carriage frame coupled with the window shell and configured to support the window shell, the carriage frame includes: one or more carriage struts extending along the shell edges, the one or more carriage struts coupled with the shell edges of the window shell; and a carriage tray extending from the one or more carriage struts to a tray end, the carriage tray coupled with the shell base.

Aspect 2 can include, or can optionally be combined with the subject matter of Aspect 1, to optionally include wherein the carriage tray is cantilevered from the one or more carriage struts.

Aspect 3 can include, or can optionally be combined with the subject matter of one or any combination of Aspects 1 or 2 to optionally include wherein the one or more carriage struts are configured to couple along upright members of a rough opening frame, and the carriage tray is configured to extend away from the upright members and the one or more carriage struts.

Aspect 4 can include, or can optionally be combined with the subject matter of one or any combination of Aspects 1-3 to optionally include wherein the window shell includes a shell profile; and the carriage frame includes a carriage profile, and the carriage profile corresponds to the shell profile.

Aspect 5 can include, or can optionally be combined with the subject matter of one or any combination of Aspects 1-4 to optionally include wherein the window shell includes a shell profile; and the carriage frame includes a carriage profile, and the carriage profile matches the shell profile.

Aspect 6 can include, or can optionally be combined with the subject matter of Aspects 1-5 to optionally include wherein the window shell includes a shell profile; and the carriage frame includes a carriage profile, and the carriage profile conforms to the shell profile.

Aspect 7 can include, or can optionally be combined with the subject matter of Aspects 1-6 to optionally include a seat panel coupled along the carriage tray between the one or more carriage struts and the tray end.

Aspect 8 can include, or can optionally be combined with the subject matter of Aspects 1-7 to optionally include wherein the window shell includes a plurality of component windows, each of the component windows includes: at least one of the component translucent panels; and a component frame including a portion of the shell frame.

Aspect 9 can include, or can optionally be combined with the subject matter of Aspects 1-8 to optionally include wherein the shell frame includes component frames of the plurality of component windows coupled together with mullion members.

Aspect 10 can include, or can optionally be combined with the subject matter of Aspects 1-9 to optionally include wherein the plurality of component translucent panels includes a canopy translucent panel.

Aspect 11 can include, or can optionally be combined with the subject matter of Aspects 1-10 to optionally include wherein the carriage tray includes one or more service ducts extending from proximate the carriage struts toward the tray end.

Aspect 12 can include, or can optionally be combined with the subject matter of Aspects 1-11 to optionally include wherein the one or more service ducts include an access port proximate to the carriage struts and a distribution port proximate to the tray end.

Aspect 13 can include, or can optionally be combined with the subject matter of Aspects 1-12 to optionally include a shade assembly proximate to strut ends of the one or more carriage struts and remote relative to the carriage tray, the shade assembly including stowed and deployed configurations.

Aspect 14 can include, or can optionally be combined with the subject matter of Aspects 1-13 to optionally include a projecting fenestration assembly comprising: a window shell having a shell base and shell edges, the window shell includes a plurality of component translucent panels surrounding a light cavity; a carriage frame coupled with the window shell and configured to support the window shell, the carriage frame includes: one or more carriage struts coupled along the shell edges of the window shell; and a carriage tray extending from the one or more carriage struts to a tray end, the carriage tray coupled along the shell base; and wherein the window shell includes a shell profile and the carriage frame includes a carriage profile, and the carriage profile corresponds with the shell profile.

Aspect 15 can include, or can optionally be combined with the subject matter of Aspects 1-14 to optionally include wherein the carriage profile corresponding with the shell profile includes the carriage profile matching the shell profile.

Aspect 16 can include, or can optionally be combined with the subject matter of Aspects 1-15 to optionally include wherein the window shell includes decoupled and installed configurations: in the decoupled configuration the window shell including the plurality of component translucent panels and the carriage frame are assembled, and the projecting fenestration assembly is decoupled from a rough opening frame; and in the installed configuration the assembled window shell and carriage frame are coupled with the rough opening frame.

Aspect 17 can include, or can optionally be combined with the subject matter of Aspects 1-16 to optionally include wherein the one or more carriage struts are configured to couple along upright members of the rough opening frame, and the carriage tray is configured to extend away from the upright members and the one or more carriage struts.

Aspect 18 can include, or can optionally be combined with the subject matter of Aspects 1-17 to optionally include the rough opening frame.

Aspect 19 can include, or can optionally be combined with the subject matter of Aspects 1-18 to optionally include wherein the carriage tray is cantilevered from the one or more carriage struts.

Aspect 20 can include, or can optionally be combined with the subject matter of Aspects 1-19 to optionally include a seat panel coupled along the carriage tray between the one or more carriage struts and the tray end.

Aspect 21 can include, or can optionally be combined with the subject matter of Aspects 1-20 to optionally include wherein the window shell includes a plurality of component windows, each of the component windows includes: at least one of the component translucent panels; and a component frame.

Aspect 22 can include, or can optionally be combined with the subject matter of Aspects 1-21 to optionally include wherein the window shell includes a shell frame having component frames of the plurality of component windows coupled together with mullion members.

Aspect 23 can include, or can optionally be combined with the subject matter of Aspects 1-22 to optionally include a light assembly coupled along one or more of the component frames or the mullion members.

Aspect 24 can include, or can optionally be combined with the subject matter of Aspects 1-23 to optionally include wherein the plurality of component translucent panels includes a component canopy translucent panel.

Aspect 25 can include, or can optionally be combined with the subject matter of Aspects 1-24 to optionally include wherein the carriage tray includes one or more service ducts extending from proximate the carriage struts toward the tray end.

Aspect 26 can include, or can optionally be combined with the subject matter of Aspects 1-25 to optionally include wherein the one or more service ducts include an access port proximate to the carriage struts and a distribution port proximate to the tray end.

Aspect 27 can include, or can optionally be combined with the subject matter of Aspects 1-26 to optionally include wherein the window shell includes one or more distribution channels in communication with the distribution port of the one or more service ducts, and the one or more distribution channels are configured to deliver ventilated air to one or more windows of the plurality of windows.

Aspect 28 can include, or can optionally be combined with the subject matter of Aspects 1-27 to optionally include a method of installing a projecting fenestration assembly comprising: coupling the projecting fenestration assembly to a rough opening frame, coupling includes: positioning the projecting fenestration assembly proximate to the rough opening frame, the projecting fenestration assembly includes a carriage frame and a window shell coupled with the carriage frame; and coupling the projecting fenestration assembly with the rough opening frame, the projecting fenestration assembly having an assembly profile corresponding to a rough opening profile of the rough opening frame; and transferring a fenestration assembly load to the rough opening frame, transferring the load includes: anchoring one or more carriage struts of the carriage frame with the rough opening frame, the one or more carriage struts extend along shell edges of the window from a carriage tray; and distributing a load of the window shell and the carriage frame through the carriage tray to the one or more anchored carriage struts and the rough opening frame.

Aspect 29 can include, or can optionally be combined with the subject matter of Aspects 1-28 to optionally include wherein anchoring the one or more carriage struts includes aligning the one or more carriage struts along upright members of the rough opening frame.

Aspect 30 can include, or can optionally be combined with the subject matter of Aspects 1-29 to optionally include wherein anchoring the one or more carriage struts includes fastening anchor brackets between the upright members and the one or more carriage struts.

Aspect 31 can include, or can optionally be combined with the subject matter of Aspects 1-30 to optionally include wherein the carriage tray includes a cantilevered carriage tray, and distributing the load of the window shell and the carriage frame includes: supporting the window shell with the cantilevered carriage tray extending from the one or more carriage struts to a tray end; absorbing a support moment corresponding to the supported window shell and the cantilevered carriage tray with the one or more carriage struts; and transmitting the load and support moment to the rough opening frame through the one or more carriage struts.

Aspect 32 can include, or can optionally be combined with the subject matter of Aspects 1-31 to optionally include coupling fascia with one or more of the window shell or the carriage frame.

Aspect 33 can include, or can optionally be combined with the subject matter of Aspects 1-32 to optionally include interconnecting one or more service ducts with a ventilation source, interconnecting includes: coupling an access port of the one or more service ducts with the ventilation source; and coupling a distribution port of the one or more service ducts with one or more distribution channels between windows of the plurality of windows.

Aspect 34 can include, or can optionally be combined with the subject matter of Aspects 1-33 to optionally include coupling a shade assembly proximate to strut ends of the one or more carriage struts and remote relative to the carriage tray.

Each of these non-limiting aspects can stand on its own, or can be combined in various permutations or combinations with one or more of the other aspects.

The above description includes references to the accompanying drawings, which form a part of the detailed description. The drawings show, by way of illustration, specific embodiments in which the invention can be practiced. These embodiments are also referred to herein as "aspects" or "examples." Such aspects or example can include elements in addition to those shown or described. However, the present inventors also contemplate aspects or examples in which only those elements shown or described are provided. Moreover, the present inventors also contemplate aspects or examples using any combination or permutation of those elements shown or described (or one or more features thereof), either with respect to a particular aspects or examples (or one or more features thereof), or with respect to other Aspects (or one or more features thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

The above description is intended to be illustrative, and not restrictive. For example, the above-described aspects or examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as aspects, examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A projecting fenestration assembly comprising:

a window shell having a plurality of component translucent panels, the window shell includes:

a shell frame having shell edges and a shell base, the shell frame surrounds a light cavity;

the plurality of component translucent panels is seated within the shell frame and surround the light cavity; and a shell profile including the shell frame and the plurality of component translucent panels, and a carriage frame coupled with the window shell and configured to support the window shell, the carriage frame includes:

one or more carriage struts extending along the shell edges, the one or more carriage struts coupled with the shell edges of the window shell;

a carriage tray extending from the one or more carriage struts to a tray end, the carriage tray coupled with the shell base; and a carriage profile including the one or more carriage struts and the carriage tray, the carriage profile is coextensive with the shell profile.

2. The projecting fenestration assembly of claim 1, wherein the carriage tray is cantilevered from the one or more carriage struts.

3. The projecting fenestration assembly of claim 1, wherein the one or more carriage struts are configured to couple along upright members of a rough opening frame, and the carriage tray is configured to extend away from the upright members and the one or more carriage struts.

4. The projecting fenestration assembly of claim 1, wherein the carriage profile matches the shell profile.

5. The projecting fenestration assembly of claim 1, wherein the carriage profile is identical to the shell profile.

6. The projecting fenestration assembly of claim 1 comprising a seat panel coupled along the carriage tray between the one or more carriage struts and the tray end.

7. The projecting fenestration assembly of claim 1, wherein the window shell includes a plurality of component windows, each of the component windows includes:

at least one of the component translucent panels; and a component frame including a portion of the shell frame.

8. The projecting fenestration assembly of claim 1, wherein the shell frame includes component frames of the plurality of component windows coupled together with mullion members.

9. The projecting fenestration assembly of claim 1, wherein the plurality of component translucent panels includes a canopy translucent panel.

10. The projecting fenestration assembly of claim 1, wherein the carriage tray includes one or more service ducts extending from proximate the one or more carriage struts toward the tray end.

11. The projecting fenestration assembly of claim 10, wherein the one or more service ducts include an access port proximate to the one or more carriage struts and a distribution port proximate to the tray end.

12. The projecting fenestration assembly of claim 1 comprising a shade assembly proximate to strut ends of the one or more carriage struts and remote relative to the carriage tray, the shade assembly including stowed and deployed configurations.

13. A projecting fenestration assembly comprising:

a window shell having a shell base and shell edges, the window shell includes a plurality of component translucent panels surrounding a light cavity;

a carriage frame coupled with the window shell and configured to support the window shell, the carriage frame includes:

one or more carriage struts coupled along the shell edges of the window shell; and a carriage tray extending from the one or more carriage struts to a tray end, the carriage tray coupled along the shell base; and wherein the window shell includes a shell profile and the carriage frame includes a carriage profile, and the carriage profile is coextensive with the shell profile.

14. The projecting fenestration assembly of claim 13, wherein the carriage profile coextensive with the shell profile includes the carriage profile matching the shell profile.

15. The projecting fenestration assembly of claim 13, wherein the window shell includes decoupled and installed configurations:

in the decoupled configuration the window shell including the plurality of component translucent panels and the carriage frame are assembled, and the projecting fenestration assembly is decoupled from a rough opening frame; and in the installed configuration the assembled window shell and carriage frame are coupled with the rough opening frame.

16. The projecting fenestration assembly of claim 15, wherein the one or more carriage struts are configured to couple along upright members of the rough opening frame, and the carriage tray is configured to extend away from the upright members and the one or more carriage struts.

17. The projecting fenestration assembly of claim 15 comprising the rough opening frame.

18. The projecting fenestration assembly of claim 13, wherein the carriage tray is cantilevered from the one or more carriage struts.

19. The projecting fenestration assembly of claim 13 comprising a seat panel coupled along the carriage tray between the one or more carriage struts and the tray end.

20. The projecting fenestration assembly of claim 13, wherein the window shell includes a plurality of component windows, each of the component windows includes:

at least one of the component translucent panels; and a component frame.

21. The projecting fenestration assembly of claim 20, wherein the window shell includes a shell frame having component frames of the plurality of component windows coupled together with mullion members.

22. The projecting fenestration assembly of claim 21 comprising a light array coupled along one or more of the component frames or the mullion members.

23. The projecting fenestration assembly of claim 13, wherein the plurality of component translucent panels includes a component canopy translucent panel.

24. The projecting fenestration assembly of claim 13, wherein the carriage tray includes one or more service ducts extending from proximate the one or more carriage struts toward the tray end.

25. The projecting fenestration assembly of claim 24, wherein the one or more service ducts include an access port proximate to the one or more carriage struts and a distribution port proximate to the tray end.

26. The projecting fenestration assembly of claim 25, wherein the window shell includes one or more distribution channels in communication with the distribution port of the one or more service ducts, and the one or more distribution channels are configured to deliver ventilated air to one or more component translucent panels of the plurality of component translucent panels.

27. The projecting fenestration assembly of claim 13, wherein the carriage profile is concealed by the shell profile.

28. The projecting fenestration assembly of claim 13, wherein the carriage profile being coextensive with the shell profile includes the carriage profile is identical to the shell profile.

29. A method of installing a projecting fenestration assembly comprising:

coupling the projecting fenestration assembly to an opening frame, the coupling includes:

positioning the projecting fenestration assembly proximate to the rough opening frame, the projecting fenestration assembly includes a carriage frame having a carriage profile and a window shell having a shell profile coupled with the carriage frame, and the carriage profile is coextensive with the shell profile; and coupling the projecting fenestration assembly with the opening frame, the projecting fenestration assembly having an assembly profile corresponding to an opening profile of the opening frame; and transferring a fenestration assembly load to the opening frame, and transferring the fenestration assembly load includes:

anchoring one or more carriage struts of the carriage frame with the opening frame, the one or more carriage struts extend along shell edges of the window shell from a carriage tray; and distributing a load of the window shell and the carriage frame through the carriage tray to the one or more carriage struts and the opening frame.

30. The method of claim 29, wherein anchoring the one or more carriage struts includes aligning the one or more carriage struts along upright members of the opening frame.

31. The method of claim 30, wherein anchoring the one or more carriage struts includes fastening anchor brackets between the upright members and the one or more carriage struts.

32. The method of claim 29, wherein the carriage tray includes a cantilevered carriage tray, and distributing the fenestration assembly load of the window shell and the carriage frame includes:

supporting the window shell with the cantilevered carriage tray extending from the one or more carriage struts to a tray end;

absorbing a support moment corresponding to the window shell and the cantilevered carriage tray with the one or more carriage struts; and transmitting the fenestration assembly load and support moment to the opening frame through the one or more carriage struts.

33. The method of claim 29 comprising coupling fascia with one or more of the window shell or the carriage frame.

34. The method of claim 29 comprising interconnecting one or more service ducts with a ventilation source, the interconnecting includes:

coupling an access port of the one or more service ducts with the ventilation source; and coupling a distribution port of the one or more service ducts with one or more distribution channels between windows of a plurality of windows.

35. The method of claim 29 comprising coupling a shade assembly proximate to strut ends of the one or more carriage struts and remote relative to the carriage tray.

* * * * *